US008794020B2

(12) United States Patent
Yamashita et al.

(10) Patent No.: US 8,794,020 B2
(45) Date of Patent: Aug. 5, 2014

(54) AIR-CONDITIONING APPARATUS

(75) Inventors: Koji Yamashita, Tokyo (JP); Hiroyuki Morimoto, Tokyo (JP); Yuji Motomura, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 407 days.

(21) Appl. No.: 13/388,781

(22) PCT Filed: Sep. 10, 2009

(86) PCT No.: PCT/JP2009/065797

§ 371 (c)(1),
(2), (4) Date: Feb. 3, 2012

(87) PCT Pub. No.: WO2011/030418

PCT Pub. Date: Mar. 17, 2011

(65) Prior Publication Data

US 2012/0131948 A1 May 31, 2012

(51) Int. Cl.

| | |
|---|---|
| ***F25B 27/00*** | (2006.01) |
| ***F24F 3/06*** | (2006.01) |
| ***F25B 13/00*** | (2006.01) |
| ***F25B 25/00*** | (2006.01) |

(52) U.S. Cl.

CPC ..... *F24F 3/06* (2013.01); *F25B 2313/02743* (2013.01); *F25B 2313/0272* (2013.01); *F25B 13/00* (2013.01); *F25B 25/005* (2013.01)

USPC ..... 62/238.7; 62/513

(58) Field of Classification Search

CPC F24F 3/06; F25B 25/005; F25B 2313/02743; F25B 13/00; F25B 2313/0272

USPC ..... 62/513, 238.7, 324.1, 222

See application file for complete search history.

(56) References Cited

U.S. PATENT DOCUMENTS 4,427,055 A * 1/1984 Heavener ..... 165/240
4,528,822 A * 7/1985 Glamm ..... 62/238.7

(Continued)

FOREIGN PATENT DOCUMENTS

JP 3-017475 A 1/1991
JP 5-280818 A 10/1993

(Continued)

OTHER PUBLICATIONS

Japanese Office Action dated Feb. 5, 2013, issued in corresponding Japanese Patent Appln. No. 2011-530673, with English translation thereof (4 pages).

(Continued)

*Primary Examiner* — Mohammad M Ali

(74) *Attorney, Agent, or Firm* — Buchanan Ingersoll & Rooney PC

(57) ABSTRACT

An air-conditioning apparatus is provided with a refrigerant cycle through which a heat-source-side refrigerant is to be circulated, a first heat medium channel to which a pump is connected and through which a heat medium such as water, an anti-freezing solution or the like is circulated, a first heat medium channel to which a pump is connected and through which a heat medium is circulated, and a plurality of use-side heat exchangers connected to the first heat medium channels. Also, the first heat medium channels are connected to the suction side of a pump through a pump flow direction switching device, and the first heat medium channels are connected to the discharge side of the pump through a pump flow direction switching device. By controlling opening degrees of the pump flow direction switching devices, the first heat medium channel which communicates with the pump is selected.

9 Claims, 10 Drawing Sheets

(56) References Cited

U.S. PATENT DOCUMENTS

| | | | | |
|---|---|---|---|---|
| 4,565,070 | A * | 1/1986 | Raymond | 62/81 |
| 4,722,197 | A * | 2/1988 | McEntire | 62/235.1 |
| 4,771,610 | A * | 9/1988 | Nakashima et al. | 62/160 |
| 4,878,357 | A * | 11/1989 | Sekigami et al. | 62/160 |
| 5,279,131 | A * | 1/1994 | Urushihata et al. | 62/324.1 |
| 5,347,826 | A * | 9/1994 | Hayashida et al. | 62/197 |
| 5,490,399 | A * | 2/1996 | Sada | 62/510 |
| 6,883,342 | B2 * | 4/2005 | Kato et al. | 62/238.7 |
| 2004/0000399 | A1 * | 1/2004 | Gavula | 165/299 |
| 2006/0137381 | A1 * | 6/2006 | Choi et al. | 62/324.1 |
| 2006/0162353 | A1 * | 7/2006 | Ha et al. | 62/149 |
| 2007/0130978 | A1 * | 6/2007 | Honda | 62/238.7 |
| 2007/0245752 | A1 * | 10/2007 | Honda | 62/115 |
| 2008/0092572 | A1 * | 4/2008 | Kim | 62/160 |
| 2008/0156034 | A1 * | 7/2008 | Cur et al. | 62/449 |
| 2008/0236189 | A1 * | 10/2008 | Honda et al. | 62/468 |
| 2009/0255284 | A1 * | 10/2009 | Yoshimi | 62/149 |
| 2010/0154447 | A1 * | 6/2010 | Yoshimi et al. | 62/149 |

FOREIGN PATENT DOCUMENTS

| | | | |
|---|---|---|---|
| JP | 2001-289465 | A | 10/2001 |
| JP | 2002-106995 | A | 4/2002 |
| JP | 2003-343936 | A | 12/2003 |
| JP | 2004-053069 | A | 2/2004 |
| JP | 2005-140444 | A | 6/2005 |

OTHER PUBLICATIONS

Chinese Office Action ( Notification of the First Office Action) dated Oct. 24, 2013, issued in corresponding Chinese Application No. 200980161350.3 with English Translation (6 pgs).

International Search Report (PCT/ISA/210) issued on Dec. 22, 2009, by Japanese Patent Office as the International Searching Authority for International Application No. PCT/JP2009/065797.

* cited by examiner

AIR-CONDITIONING APPARATUS

TECHNICAL FIELD

The present invention relates to an air-conditioning apparatus applied to a multi air-conditioning apparatus for a building, for example.

BACKGROUND ART

In an air-conditioning apparatus such as a multi air-conditioning apparatus for a building or the like, a refrigerant is circulated between an outdoor unit, which is a heat source unit arranged outside the building, and an indoor unit arranged inside the room of the building, for example. Then, the refrigerant dissipates or absorbs heat, and cooling or heating of the air conditioning space is performed by the heated or cooled air. As for the refrigerant, HFC (hydrofluorocarbon) refrigerant, for example, is often used. Also, use of a natural refrigerant such as carbon dioxide ($CO_2$) or the like has been proposed.

Also, in an air-conditioning apparatus called a chiller, cooling energy or heating energy is generated by the heat source unit arranged outside the building. Then, water, an anti-freezing solution or the like is heated or cooled by a heat exchanger arranged in the outdoor unit and conveyed to a fan coil unit, a panel heater or the like, which is an indoor unit, so as to perform cooling or heating (See Patent Literature 1, for example).

Also, an apparatus called an exhaust heat recovery chiller is known in which four water pipelines are connected between the heat source unit and the indoor unit, cooled or heated water or the like is supplied simultaneously, and cooling or heating can be freely selected in the indoor unit (See Patent Literature 2, for example).

Also, an apparatus is known that is configured such that heat exchangers for primary refrigerant and secondary refrigerant are arranged in the vicinity of each indoor unit and the secondary refrigerant is conveyed to the indoor unit (See Patent Literature 3, for example).

Also, an apparatus is known which is configured such that branch units having an outdoor unit and a heat exchanger are connected by two pipelines so that the secondary refrigerant is conveyed to the indoor unit (See Patent Literature 4, for example).

CITATION LIST

Patent Literature

Patent Literature 1: Japanese Unexamined Patent Application Publication No. 2005-140444 (page 4, FIG. 1 and the like)

Patent Literature 2: Japanese Unexamined Patent Application Publication No. 5-280818 (pages 4 and 5, FIG. 1 and the like)

Patent Literature 3: Japanese Unexamined Patent Application Publication No. 2001-289465 (pages 5 to 8, FIGS. 1 and 2 and the like)

Patent Literature 4: Japanese Unexamined Patent Application Publication No. 2003-343936 (page 5, FIG. 1)

SUMMARY OF INVENTION

Technical Problem

Regarding the prior-art air-conditioning apparatuses such as a multi air-conditioning apparatus for a building, there is a concern that the refrigerant may leak into a room or the like since the refrigerant is circulated to the indoor unit. On the other hand, in the air-conditioning apparatuses as described in Patent Literature 1 and Patent Literature 2, the refrigerant does not pass through the indoor unit. However, in the air-conditioning apparatuses described in Patent Literature 1 and Patent Literature 2, a heat medium needs to be heated or cooled in the heat source unit outside the building and conveyed to the indoor unit side. Thus, a circulation path for the heat medium becomes longer. Here, if heat which performs the work of predetermined heating or cooling is to be conveyed by the heat medium, an amount of energy consumed becomes larger than that of the refrigerant due to conveyance power or the like. Therefore, if the circulation path becomes longer, the conveying power becomes extremely large. From this fact, it is known that if the circulation of the heat medium can be controlled well, energy can be saved in the air-conditioning apparatus.

In the air-conditioning apparatus as described in Patent Literature 2, four pipelines need to be connected from the outdoor side into the room so that cooling or heating can be selected at each indoor unit, which makes the efficiency of construction work poor. Also, the capacity of secondary medium circulating means such as a pump needs to be able to handle the maximum air-conditioning load assumed to be in the air-conditioning space. Thus, the energy efficiency of the system is poor.

In the air-conditioning apparatus described in Patent Literature 3, since the secondary heat medium circulating means such as a pump needs to be provided individually in each indoor unit, the system is not only expensive but also has increased noise and is not practical. In addition, since the heat exchanger is located in the vicinity of the indoor unit, a risk of the refrigerant leaking into a place close to the inside of the room cannot be eliminated.

In the air-conditioning apparatus as described in Patent Literature 4, since the primary refrigerant after heat exchange flows into the same channel as the primary refrigerant before the heat exchange, when a plurality of indoor units are connected, the maximum capacity cannot be exerted in each indoor unit, resulting in a wasteful configuration in terms of energy. Also, since the connection between the branch unit and an extension pipeline is made by two pipelines for cooling and two pipelines for heating, that is, a total of four pipelines, the configuration is similar to that in which the outdoor unit and the branch unit are connected by four pipelines as a result, and the system is also poor in workability of construction.

The present invention was made to solve at least one of the above-described problems and a first object thereof is to provide an air-conditioning apparatus capable of saving energy. In addition to the first object, a second object is to provide an air-conditioning apparatus in which safety is improved without circulating the refrigerant to the indoor unit or the vicinity of the indoor unit, workability of construction is improved by decreasing the number of connection pipelines between the outdoor unit and the branch unit or with the indoor unit and energy efficiency is improved.

Solution to Problem

An air-conditioning apparatus according to the present invention has at least a compressor, a heat-source-side heat exchanger, a plurality of expansion devices, a plurality of heat exchangers related to heat medium, a plurality of first heat-medium feeding devices, a plurality of use-side heat exchangers, a second heat-medium feeding devices, a first heat-medium flow direction switching device, and a second heat-medium flow direction switching device. The apparatus comprises a refrigerant cycle connecting the compressor, the heat-source-side heat exchanger, the plurality of expansion devices, and heat-source-side refrigerant channels of the plurality of heat exchangers related to heat medium and circulating a heat-source-side refrigerant, a plurality of first heat medium channels each connecting the heat-medium-side channel of the heat exchanger related to heat medium and the first heat-medium feeding device and circulating a heat medium different from the heat-source-side, and a plurality of heat-medium cycles each connecting the use-side heat exchanger and at least one of the first heat medium channels and circulating the heat medium. The first heat-medium flow direction switching device is connected to the suction side of the second heat-medium feeding device and at least two of the first heat medium channels. The second heat-medium flow direction switching device is connected to the discharge side of the second heat-medium feeding device and the first heat medium channel to which the first heat-medium flow direction switching device is connected. The apparatus selects the first heat medium channel, which communicates with the second heat-medium feeding device, by controlling the first heat-medium flow direction switching device and the second heat-medium flow direction switching device.

Advantageous Effects of Invention

According to the air-conditioning apparatus according to the present invention, since the first heat medium channel in which the first heat-medium feeding device with a high pressure-feed load is provided is made to communicate with the second heat-medium feeding device, the capacity of the first feeding device can be reduced. Thus, energy of the air-conditioning apparatus can be saved.

DESCRIPTION OF EMBODIMENTS

An embodiment of the present invention will be described below on the basis of the attached drawings.

Figure 1:
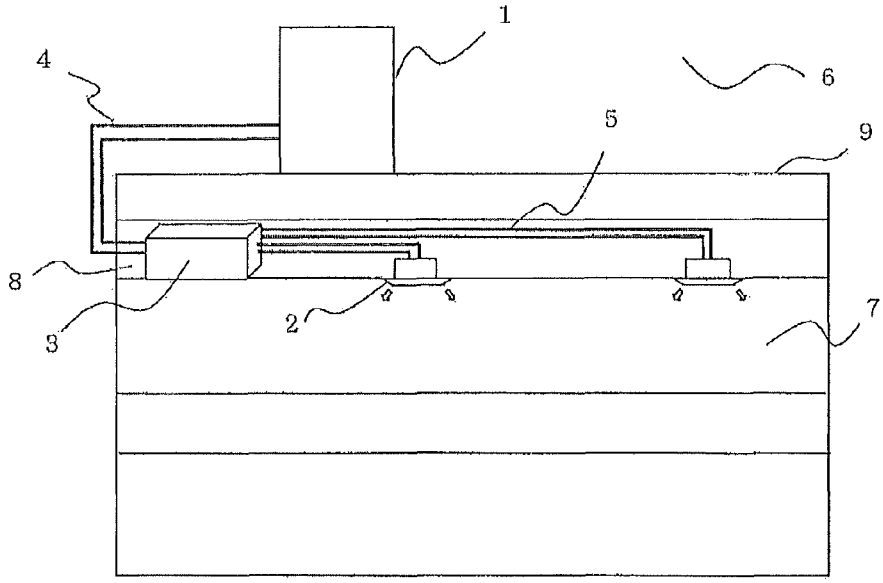
FIG. 1 is a schematic diagram illustrating an example of installation of an air-conditioning apparatus according to an embodiment of the present invention.
Figure 2:
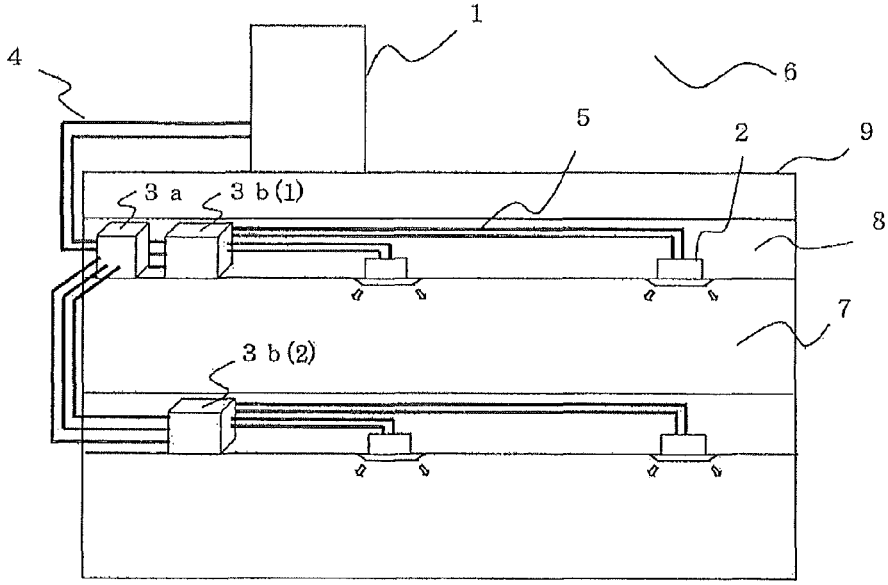
FIG. 2 is a schematic diagram illustrating an example of installation of the air-conditioning apparatus according to the embodiment of the present invention.

FIGS. 1 and 2 are schematic diagrams illustrating an example of installation of an air-conditioning apparatus according to the embodiment of the present invention. On the basis of FIGS. 1 and 2, the example of installation of the air-conditioning apparatus will be described. In this air-conditioning apparatus, each indoor unit can freely select a cooling mode or a heating mode as the operation mode thereof by using a refrigeration cycle (a refrigerant cycle A, a heat medium channel B, and a heat medium channel C) through which a refrigerant (a heat-source-side refrigerant, a heat medium) is to be circulated. Including FIG. 1, the relationships among the sizes of constituent members might be different from actual ones in the following drawings.

In FIG. 1, the air-conditioning apparatus according to the embodiment has one outdoor unit 1, which is a heat source unit, a plurality of indoor units 2, and a relay unit 3 interposed between the outdoor unit 1 and the indoor units 2. The relay unit 3 exchanges heat between a heat-source-side refrigerant and a heat medium. The outdoor unit 1 and the relay unit 3 are connected to each other by refrigerant pipelines 4 through which the heat-source-side refrigerant flows. The relay unit 3 and the indoor units 2 are connected to each other by pipelines 5 through which a heat medium such as water, an anti-freezing solution or the like flows. Then, cooling energy or heating energy generated in the outdoor unit 1 is fed to the indoor units 2 through the relay unit 3.

In FIG. 2, the air-conditioning apparatus according to the embodiment has one outdoor unit 1, a plurality of the indoor units 2, and the relay unit 3 (a main relay unit 3*a* and sub relay units 3*b*) divided into plural and interposed between the outdoor unit 1 and the indoor units 2. The outdoor unit 1 and the main relay unit 3*a* are connected to each other by a refrigerant pipeline 4. The main relay unit 3*a* and the sub relay units 3*b* are connected by the refrigerant pipeline 4. The sub relay units 3*b* and the indoor units 2 are connected by the pipeline 5. Then, the cooling energy or heating energy generated in the outdoor unit 1 is fed to the indoor units 2 through the main relay unit 3*a* and the sub relay units 3*b*.

The outdoor unit 1 is usually arranged in an outdoor space 6, which is a space outside a building 9 such as a building or the like (on the roof or the like, for example) and supplies cooling energy or heating energy to the indoor units 2 through the relay unit 3. The indoor units 2 are arranged at positions where cooling air or heating air can be supplied to an indoor space 7, which is a space inside the building 9 (a living room or the like, for example) and is an air-conditioning space, so that the air for cooling or the air for heating can be supplied to the indoor space 7, which is the air-conditioning space. The relay unit 3 is configured with a housing different from that of the outdoor unit 1 and the indoor units 2 so as to be able to be installed at a position different from those of the outdoor space 6 and the indoor space 7, is connected to the outdoor unit 1 and the indoor units 2 by the refrigerant pipeline 4 and the pipeline 5, respectively, and transmits cooling energy or heating energy supplied from the outdoor unit 1 to the indoor units 2.

As illustrated in FIGS. 1 and 2, in the air-conditioning apparatus according to the embodiment, the outdoor unit 1 and the relay unit 3 are connected by using two refrigerant pipelines 4 and the relay unit 3 and each of the indoor units 2 by using two pipelines 5, respectively. As described above, in the air-conditioning apparatus according to the embodiment, by connecting each unit (the outdoor unit 1, the indoor units 2, and the relay unit 3) by using the two pipelines (the refrigerant pipeline 4 and the pipeline 5), construction work of the pipelines and the like is facilitated, and installation of the air-conditioning apparatus is also facilitated.

As illustrated in FIG. 2, the relay unit 3 can be divided into one main relay unit 3*a* and two sub relay units 3*b* (a sub relay unit 3*b*(1) and a sub relay unit 3*b*(2)) deriving from the main relay unit 3*a*. Through the above division, a plurality of the sub relay units 3*b* can be connected to one main relay unit 3*a*. In this configuration, the number of the refrigerant pipelines 4 which connect the main relay unit 3*a* and the sub relay units 3*b* to each other is three. The details of this circuit will be described later in detail (See FIG. 3A).

In FIGS. 1 and 2, a state in which the relay unit 3 is installed in a space such as a space under roof, which is a space inside the building 9 but is different from the indoor space 7 (hereinafter simply referred to as a space 8) is illustrated as an example. The relay unit 3 can be also installed in a common space where an elevator is located or the like. Also, in FIGS. 1 and 2, an example in which the indoor unit 2 is a ceiling cassette type is illustrated but this is not limiting, and any type such as a ceiling-concealed type, a ceiling-suspended type or the like may be adopted as long as heating air or cooling air can be blown out directly or through a duct or the like into the indoor space 7.

In FIGS. 1 and 2, an example in which the outdoor unit 1 is installed in the outdoor space 6 is illustrated, but it is not limited thereto. For example, the outdoor unit 1 may be installed in a surrounded space such as a machine room having a ventilation port or the like, may be installed inside the building 9 as long as exhaust heat can be exhausted to outside the building 9 by an exhaust duct or may be installed inside the building 9 if a water-cooled type outdoor unit 1 is used. No particular problem will occur if the outdoor unit 1 is installed in such places.

Also, the relay unit 3 can be installed in the vicinity of the outdoor unit 1. However, if the distance from the relay unit 3 to the indoor unit 2 is too long, conveyance power of the heat medium becomes considerably large, and note should be taken that the effect of energy saving becomes small. Moreover, the numbers of connected outdoor units 1, the indoor units 2, and the relay units 3 are not limited to the numbers illustrated in FIGS. 1 and 2 but the numbers may be determined in accordance with the building 9 in which the air-conditioning apparatus according to the embodiment is to be installed.

Figure 3:
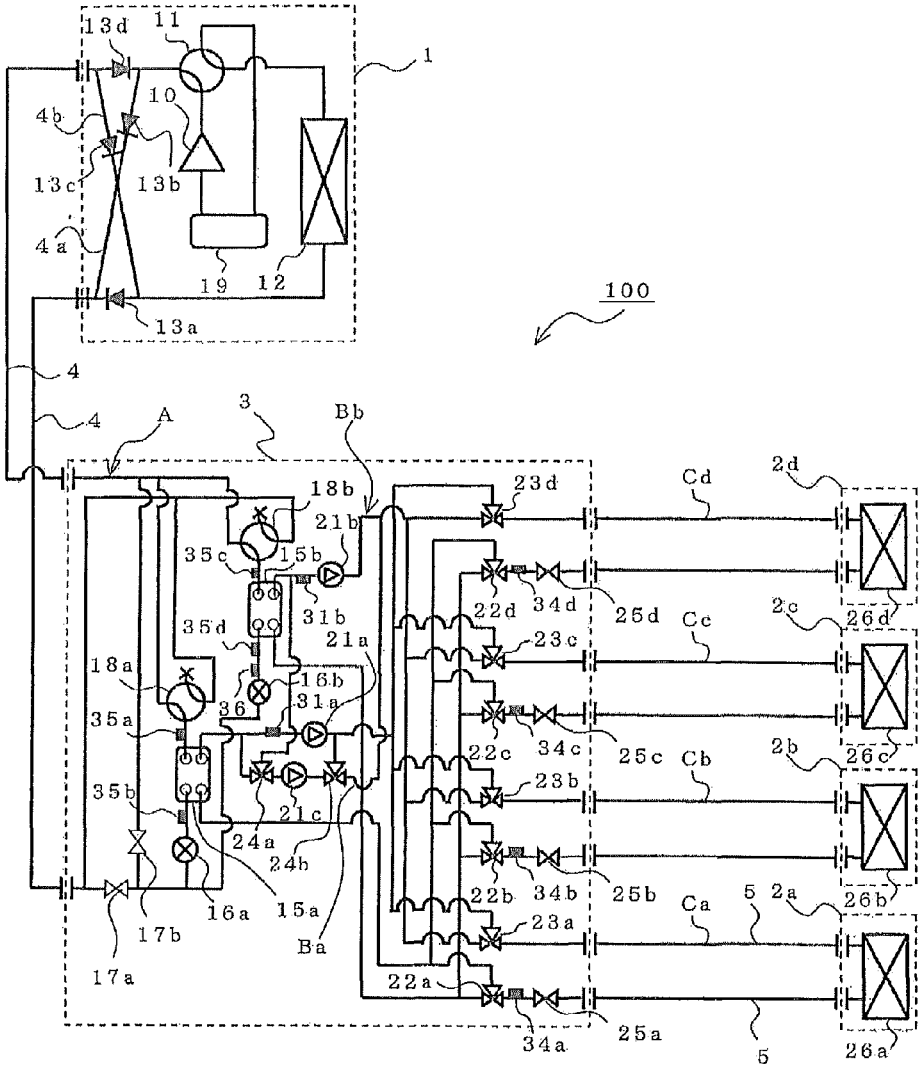
FIG. 3 is a schematic circuit configuration diagram illustrating an example of a circuit configuration of the air-conditioning apparatus according to the embodiment of the present invention.

FIG. 3 is a schematic circuit configuration diagram illustrating an example of a circuit configuration of an air-conditioning apparatus according to the embodiment (hereinafter referred to as an air-conditioning apparatus 100). On the basis of FIG. 3, a detailed configuration of the air-conditioning apparatus 100 will be described. As illustrated in FIG. 3, the outdoor unit 1 and the relay unit 3 are connected by the refrigerant pipelines 4 via a heat exchanger related to heat medium 15*a* and a heat exchanger related to heat medium 15*b* provided in the relay unit 3. Also, both the relay unit 3 and the indoor unit 2 are connected by the pipelines 5 via the heat exchanger related to heat medium 15*a* and the heat exchanger related to heat medium 15*b*.

[Outdoor Unit 1]

In the outdoor unit 1, a compressor 10, a first refrigerant flow direction switching device 11 such as a four way valve or the like, a heat-source-side heat exchanger 12, and an accumulator 19 are connected in series by the refrigerant pipeline 4 and mounted. Also, in the outdoor unit 1, a first connection pipeline 4*a*, a second connection pipeline 4*b*, a check valve 13*a*, a check valve 13*b*, a check valve 13*c*, and a check valve 13*d* are disposed. By disposing the first connection pipeline 4*a*, the second connection pipeline 4*b*, the check valve 13*a*, the check valve 13*b*, the check valve 13*c*, and the check valve 13*d*, the flow of the heat-source-side refrigerant flowing into the relay unit 3 can be made to be in a certain direction regardless of the operation required by the indoor unit 2.

The compressor 10 sucks and compresses the heat-source-side refrigerant into a high-temperature and high-pressure state and may be formed of an inverter compressor or the like capable of capacity control, for example. The first refrigerant flow direction switching device 11 switches between the flow of the heat-source-side refrigerant during a heating operation (in a heating only operation mode and a heating-main operation mode) and the flow of the heat-source-side refrigerant during a cooling operation (in a cooling only operation mode and a cooling-main operation mode). The heat-source-side heat exchanger 12 functions as an evaporator in the heating operation, functions as a condenser (or a radiator) in the cooling operation, exchanges heat between the air supplied from a fan, not shown, and the heat-source-side refrigerant and evaporates and gasifies or condenses and liquefies the heat-source-side refrigerant. The accumulator 19 is disposed on the suction side of the compressor 10 and stores excess refrigerant.

The check valve 13*d* is disposed in the refrigerant pipeline 4 between the relay unit 3 and the first refrigerant flow direction switching device 11 and allows the flow of the heat-source-side refrigerant in only a predetermined direction (the direction from the relay unit 3 to the outdoor unit 1). The check valve 13*a* is disposed in the refrigerant pipeline 4 between the heat-source-side heat exchanger 12 and the relay unit 3 and allows the flow of the heat-source-side refrigerant in only a predetermined direction (the direction from the outdoor unit 1 to the relay unit 3). The check valve 13*b* is disposed in the first connection pipeline 4*a* and allows the heat-source-side refrigerant discharged from the compressor 10 in the heating operation to circulate the relay unit 3. The check valve 13*c* is disposed in the second connection pipeline 4*b* and allows the heat-source-side refrigerant returned from the relay unit 3 in the heating operation to circulate the suction side of the compressor 10.

The first connection pipeline 4*a* connects the refrigerant pipeline 4 between the first refrigerant flow direction switching device 11 and the check valve 13*d* and the refrigerant pipeline 4 between the check valve 13*a* and the relay unit 3 in the outdoor unit 1. The second connection pipeline 4*b* connects the refrigerant pipeline 4 between the check valve 13*d* and the relay unit 3 and the refrigerant pipeline 4 between the heat-source-side heat exchanger 12 and the check valve 13*a* in the outdoor unit 1. In FIG. 3, the example in which the first connection pipeline 4*a*, the second connection pipeline 4*b*, the check valve 13*a*, the check valve 13*b*, the check valve 13*c*, and the check valve 13*d* are disposed is illustrated but this is not limiting, and they do not necessarily have to be disposed.

[Indoor Unit 2]

In each of the indoor units 2, a use-side heat exchanger 26 is mounted. This use-side heat exchanger 26 is connected to a heat medium flow control device 25 and the second heat medium flow direction switching device 23 of the relay unit 3 by the pipeline 5. This use-side heat exchanger 26 exchanges heat between the air supplied from a fan, not shown, and the heat medium and generates heating air or cooling air to be supplied to the indoor space 7.

In FIG. 3, an example in which four indoor units 2 are connected to the relay unit 3 is exemplified and illustrated as an indoor unit 2*a*, an indoor unit 2*b*, an indoor unit 2*c*, and an indoor unit 2*d* from the lower part in the figure. Also, in accordance with the indoor unit 2*a* to the indoor unit 2*d*, the use-side heat exchanger 26 is illustrated as a use-side heat exchanger 26*a*, a use-side heat exchanger 26*b*, a use-side heat exchanger 26*c*, and a use-side heat exchanger 26*d* from the lower part in the figure. Similarly to FIGS. 1 and 2, the number of connected indoor units 2 is not limited to the four illustrated in FIG. 3.

[Relay Unit 3]

In the relay unit 3, two heat exchangers related to heat medium 15, two expansion devices 16, two on-off devices 17, two second refrigerant flow direction switching devices 18, three pumps 21 (a pump 21*a*, a pump 21*b*, and a pump 21*c*), four first heat-medium flow direction switching devices 22, four second heat-medium flow direction switching devices 23, two pump flow direction switching devices 24 (a pump flow direction switching device 24*a* and a pump flow direction switching device 24*b*), and four heat medium flow control devices 25 are mounted. The relay unit 3 divided into the main relay unit 3*a* and the sub relay units 3*b* will be described in FIG. 3A.

Here, the pump 21*a* and the pump 21*b* correspond to the first heat-medium feeding device of the present invention. The pump 21*c* corresponds to the second heat-medium feeding device of the present invention. The first heat-medium flow direction switching device 22 corresponds to the third heat-medium flow direction switching device of the present invention. The second heat-medium flow direction switching device 23 corresponds to the fourth heat-medium flow direction switching device of the present invention. Among the pump flow direction switching devices 24, the pump flow direction switching device 24*a* disposed on the suction side of the pump 21*c* corresponds to the first heat-medium flow direction switching device of the present invention, and the pump flow direction switching device 24*b* disposed on the discharge side of the pump 21*c* corresponds to the second heat-medium flow direction switching device of the present invention. The first heat-medium feeding device is formed of one pump (the pump 21*a* or the pump 21*b*) but may be formed of a plurality of pumps. Also, the second heat-medium feeding device is formed of one pump (the pump 21*c*) but may be formed of a plurality of pumps.

The two heat exchangers related to heat medium 15 (the heat exchanger related to heat medium 15*a* and the heat exchanger related to heat medium 15*b*) function as a condenser (radiator) or an evaporator, exchange heat between the heat-source-side refrigerant and the heat medium, and transmit cooling energy or heating energy generated in the outdoor unit 1 and stored in the heat-source-side refrigerant to the heat medium. The heat exchanger related to heat medium 15*a* is disposed between an expansion device 16*a* and a second refrigerant flow direction switching device 18*a* in a refrigerant cycle A and is used for cooling of the heat medium in the cooling and heating mixed operation mode. Also, the heat exchanger related to heat medium 15*b* is disposed between an expansion device 16*b* and a second refrigerant flow direction switching device 18*b* in a refrigerant cycle A and is used for heating of the heat medium in the cooling and heating mixed operation mode.

The two expansion devices 16 (the expansion device 16*a* and the expansion device 16*b*) have a function of a reducing valve or an expansion valve and reduce the pressure of and expand the heat-source-side refrigerant. The expansion device 16*a* is disposed on the upstream side of the heat exchanger related to heat medium 15*a* in the flow of the heat-source-side refrigerant in the cooling operation. The expansion device 16*b* is disposed on the upstream side of the heat exchanger related to heat medium 15*b* in the flow of the heat-source-side refrigerant in the cooling operation. The two expansion devices 16 are preferably formed of devices capable of variable control of opening degrees or an electronic expansion valve or the like, for example.

The two on-off valves 17 (the on-off device 17*a* and the on-off device 17*b*) are formed of two-way valves or the like and open/close the refrigerant pipeline 4. The on-off device 17*a* is disposed in the refrigerant pipeline 4 on the inlet side of the heat-source-side refrigerant. The on-off device 17*b* is disposed in the pipeline which connects the inlet side of the heat-source-side refrigerant and refrigerant pipeline 4 on the outlet side. The two second refrigerant flow direction switching devices 18 (the second refrigerant flow direction switching device 18*a* and the second refrigerant flow direction switching device 18*b*) are formed of four-way valves or the like and switch the flow of the heat-source-side refrigerant in accordance with the operation mode. The second refrigerant flow direction switching device 18*a* is disposed on the downstream side of the heat exchanger related to heat medium 15*a* in the flow of the heat-source-side refrigerant in the cooling operation. The second refrigerant flow direction switching device 18*b* is disposed on the downstream side of the heat exchanger related to heat medium 15*b* in the flow of the heat-source-side refrigerant in the cooling only operation. That is, the on-off device 17*a*, the on-off device 17*b*, the second refrigerant flow direction switching device 18*a*, and the second refrigerant flow direction switching device 18*b* form a flow direction switching section which switches the flow direction of the heat medium flowing through the heat exchanger related to heat medium 16*a* and the heat exchanger related to heat medium 15*b* in accordance with the operation mode. If only the cooling-main operation mode or the heating-only operation mode or the like, which will be described later, is to be performed, it is not necessary to switch the flow direction of the heat medium flowing through the heat exchanger related to heat medium 15*a* and the heat exchanger related to heat medium 15*b*, and the flow direction switching section does not have to be provided.

The three pumps 21 (the pump 21*a*, the pump 21*b*, and the pump 21*c*) circulate the heat medium flowing through the pipeline 5. The pump 21*a* is disposed in the pipeline 5 between the heat exchanger related to heat medium 15*a* and the second heat medium flow direction switching device 23. The pump 21*b* is disposed in the pipeline 5 between the heat exchanger related to heat medium 15*b* and the second heat medium flow direction switching device 23. The pump 21*c* is disposed between the two pump flow direction switching devices 24 (the pump flow direction switching device 24*a* and the pump flow direction switching device 24*b*). The two pump flow direction switching devices 24 (the pump flow direction switching device 24*a* and the pump flow direction switching device 24*b*) are formed of three-way valves or the like and switch the flow direction of the heat medium. The pump flow direction switching device 24*a* has one of the three ways connected to the suction side of the pump 21*a*, another of the three ways connected to the suction side of the pump 21*b*, and the rest of the three ways connected to the suction side of the pump 21*c*. The pump flow direction switching device 24*b* has one of the three ways connected to the discharge side of the pump 21*a*, another of the three ways connected to the discharge side of the pump 21*b*, and the rest of the three ways connected to the discharge side of the pump 21*c*.

The three pumps 21 are preferably formed of pumps capable of variable control of the capacity, for example.

The four first heat medium flow direction switching devices 22 (the first heat medium flow direction switching device 22*a* to the first heat medium flow direction switching device 22*d*) are formed of three-way valves or the like and switch the flow direction of the heat medium. The first heat medium flow direction switching devices 22 are provided with a number corresponding to the number of installed indoor units 2 (here, four). In the first heat medium flow direction switching device 22, one of the three ways is connected to the heat exchanger related to heat medium 15*a*, another of the three ways to the heat exchanger related to heat medium 15*b*, and the rest of the three ways to the heat medium flow control device 25, respectively, and are disposed on the outlet side of the heat medium channel of the use-side heat exchanger 26. They are illustrated corresponding to the indoor units 2 as the first heat medium flow direction switching device 22*a*, the first heat medium flow direction switching device 22*b*, the first heat medium flow direction switching device 22*c*, and the first flow direction switching device 22*d* from the lower part in the figure.

The four second heat medium flow direction switching devices 23 (the second heat medium flow direction switching device 23*a* to the second heat medium flow direction switching device 23*d*) are formed of three-way valves or the like and switch the flow direction of the heat medium. The second heat medium flow direction switching devices 23 are provided in a number corresponding to the number of installed indoor units 2 (here, four). In the second heat medium flow direction switching device 23, one of the three ways is connected to the heat exchanger related to heat medium 15*a*, another of the three ways to the heat exchanger related to heat medium 15*b*, and the rest of the three ways to the inlet side of the heat medium channel of the use-side heat exchanger 26, respectively. They are illustrated corresponding to the indoor units 2 as the second heat medium flow direction switching device 23*a*, the second heat medium flow direction switching device 23*b*, the second heat medium flow direction switching device 23*c*, and the second flow direction switching device 23*d* from the lower part in the figure.

The four heat medium flow control devices 25 (the heat medium flow control device 25*a* to the heat medium flow control device 25*d*) are formed of two-way valves or the like using a stepping motor, for example, and controls the flow rate of the heat medium by enabling change of the opening degree of the pipeline 5, which is a heat medium channel. The heat medium flow control devices 25 are provided in a number corresponding to the number of installed indoor units 2 (here, four). One side of the heat medium flow control device 25 is connected to the use-side heat exchanger 26 and the other side to the first heat medium flow direction switching device 22, respectively, and is disposed on the outlet side of the heat medium channel of the use-side heat exchanger 26. They are illustrated corresponding to the indoor units 2 as the heat medium flow control device 25*a*, the heat medium flow control device 25*b*, the heat medium flow control device 25*c*, and the heat medium flow control device 25*d* from the lower part in the figure.

Also, in the relay unit 3, various detecting means (two first temperature sensors 31, four second temperature sensors 34, four third temperature sensors 35, and a pressure sensor 36) are disposed. Information (temperature information and pressure information) detected by these detecting means is sent to a controller (not shown) that integrally controls the operation of the air-conditioning apparatus 100 and is used for control of the running frequency of the compressor 10, the rotation speed of the fan, not shown, switching of the first refrigerant flow direction switching device 11, the running frequency of the pump 21, switching of the second refrigerant flow direction switching device 18, switching of a flow direction of the heat medium and the like.

The two first temperature sensors 31 (the first temperature sensor 31*a* and the first temperature sensor 31*b*) detect the temperature of the heat medium flowing out of the heat exchanger related to heat medium 15, that is, the temperature of the heat medium at the outlet of the heat exchanger related to heat medium 15 and may be formed of a thermistor or the like, for example. The first temperature sensor 31*a* is disposed in the pipeline 5 on the inlet side of the pump 21*a*. The first temperature sensor 31*b* is disposed in the pipeline 5 on the inlet side of the pump 21*b*.

The four second temperature sensors 34 (the second temperature sensor 34*a* to the second temperature sensor 34*d*) are disposed between the first heat medium flow direction switching device 22 and the heat medium flow control device 25 to detect the temperature of the heat medium flowing out of the use-side heat exchanger 26 and may be formed of a thermistor or the like. The second temperature sensors 34 are disposed in a number corresponding to the number of installed indoor units 2 (here, four). They are illustrated corresponding to the indoor units 2 as the second temperature sensor 34*a*, the second temperature sensor 34*b*, the second temperature sensor 34*c*, and the second temperature sensor 34*d* from the lower part of the figure.

The four third temperature sensors 35 (the third temperature sensor 35*a* to the third temperature sensor 35*d*) are disposed on the inlet side or the outlet side of the heat-source-side refrigerant of the heat exchanger related to heat medium 15, detect the temperature of the heat-source-side refrigerant flowing into the heat exchanger related to heat medium 15 or the temperature of the heat-source-side refrigerant flowing out of the heat exchanger related to heat medium 15 and may be formed of a thermistor or the like. The third temperature sensor 35*a* is disposed between the heat exchanger related to heat medium 15*a* and the second refrigerant flow direction switching device 18*a*. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow direction switching device 18*b*. The third temperature sensor 35*d* is disposed between the heat exchanger related to heat medium 15*b* and the expansion device 16*b*.

The pressure sensor 36 is, similarly to the installation position of the third temperature sensor 35*d*, disposed between the heat exchanger related to heat medium 15*b* and the expansion device 16*b* and detects the pressure of the heat-source-side refrigerant flowing between the heat exchanger related to heat medium 15*b* and the expansion device 16*b*.

Also, the controller, not shown, is formed of a microcomputer or the like, to control the running frequency of the compressor 10, the rotation speed (including on/off) of the fan, switching of the first refrigerant flow direction switching device 11, running of the pump 21, the opening degree of the expansion device 16, on/off of the on-off device 17, switching of the second refrigerant flow direction switching device 18, switching of the first heat medium flow direction switching device 22, switching of the second heat medium flow direction switching device 23, switching of the pump flow direction switching device 24, running of the heat medium flow control device 25 and the like and executes each operation mode, which will be described later. The controller may be disposed in each unit or may be disposed in the outdoor unit 1 or the relay unit 3.

The pipelines 5 through which the heat medium passes are formed of a pipeline connected to the heat exchanger related to heat medium 15*a* and a pipeline connected to the heat exchanger related to heat medium 15*b*. The pipeline 5 branches in accordance with the number of the indoor units 2 connected to the relay unit 3 (here, four branches each). The pipelines 5 are connected at the first heat medium flow direction switching device 22 and the second heat medium flow direction switching device 23. By controlling the first heat medium flow direction switching device 22 and the second heat medium flow direction switching device 23, it is determined whether the heat medium from the heat exchanger related to heat medium 15*a* flows into the use-side heat exchanger 26 or the heat medium from the heat exchanger related to heat medium 15*b* flows into the use-side heat exchanger 26.

In the air-conditioning apparatus 100, the compressor 10, the first refrigerant flow direction switching device 11, the heat-source-side heat exchanger 12, the on-off device 17, the second refrigerant flow direction switching device 18, the refrigerant channel of the heat exchanger related to heat medium 15*a*, the expansion device 16, and the accumulator 19 are connected by the refrigerant pipeline 4 so as to constitute the refrigerant cycle A.

Also, the heat medium channel of the heat exchanger related to heat medium 15*a* and the pump 21*a* are connected by the refrigerant pipeline 5 so as to constitute a first heat medium channel Ba. The heat medium channel of the heat exchanger related to heat medium 15*b* and the pump 21*b* are connected by the refrigerant pipeline 5 so as to constitute a first heat medium channel Bb. That is, in the air-conditioning apparatus 100, there are two first heat medium channels B.

Also, the first heat medium flow direction switching device 22, the heat medium flow control device 25, the use-side heat exchanger 26, and the second heat medium flow direction switching device 23 are connected by the refrigerant pipeline 5 so as to constitute a second heat medium channel C. In FIG. 3, the example in which four use-side heat exchangers 26 are disposed is exemplified, and they are illustrated from the lower side of the figure as a second heat medium channel Ca, a second heat medium channel Cb, a second heat medium channel Cc, and a second heat medium channel Cd. The first heat medium flow direction switching device 22 and the second heat medium flow direction switching device 23 are connected to the first heat medium channel Ba and the first heat medium channel Bb.

Thus, in the air-conditioning apparatus 100, the outdoor unit 1 and the relay unit 3 are connected through the heat exchanger related to heat medium 15*a* and the heat exchanger related to heat medium 15*b* disposed in the relay unit 3, and both the relay unit 3 and the indoor units 2 are connected through the heat exchanger related to heat medium 15*a* and the heat exchanger related to heat medium 15*b*. That is, in the air-conditioning apparatus 100, the heat-source-side refrigerant circulating through the refrigerant cycle A and the heat medium circulating through the first heat medium channel B and the second heat medium channel C are adapted to exchange heat with the heat exchanger related to heat medium 15*a* and the heat exchanger related to heat medium 15*b*.

By configuring the air-conditioning apparatus 100 as above, the heat medium is circulated through the indoor units 2 which condition air in the indoor space 7, which is an air-conditioning space, and the refrigerant is not circulated. Thus, even if the refrigerant leaks, intrusion thereof into the indoor space 7 can be suppressed, and the safe air-conditioning apparatus 100 can be obtained. Also, since freedom in selection of a place in which the relay unit 3 is installed is increased, the pipeline through which the heat medium is to be circulated can be made shorter than the air-conditioning apparatus such as a chiller, and conveyance power can be small. Therefore, energy of the air-conditioning apparatus 100 can be saved.

Figure 3A:
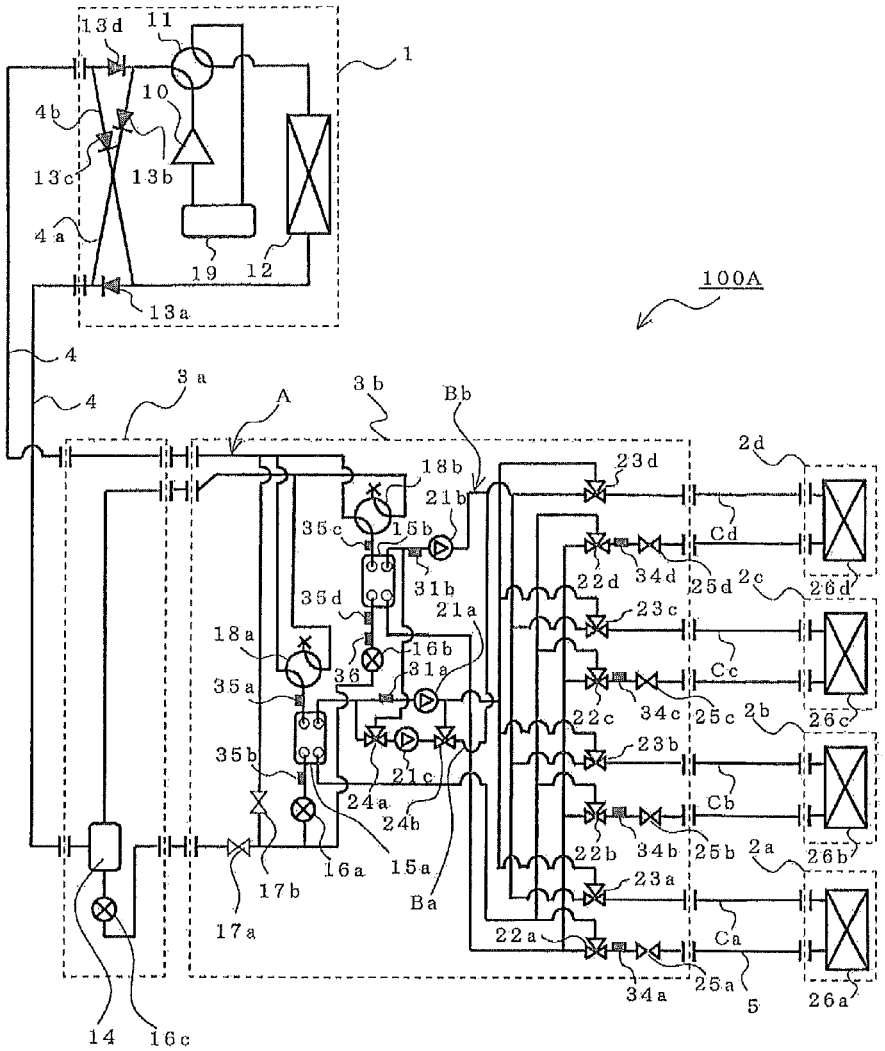
FIG. 3A is an outline circuit configuration diagram illustrating another example of a circuit configuration of the air-conditioning apparatus according to the embodiment of the present invention.

FIG. 3A is a schematic circuit configuration diagram illustrating another example of a circuit configuration of an air-conditioning apparatus according to the embodiment (hereinafter referred to as an air-conditioning apparatus 100A). On the basis of FIG. 3A, the circuit configuration of the air-conditioning apparatus 100A when the relay unit 3 is divided into the main relay unit 3*a* and the sub relay unit 3*b* will be described. As illustrated in FIG. 3A, the relay unit 3 is formed of separate housings, that is, the main relay unit 3*a* and the sub relay unit 3*b*. By configuring the air-conditioning apparatus as above, a plurality of the sub relay units 3*b* can be connected to the one main relay unit 3*a* as illustrated in FIG. 2.

In the main relay unit 3*a*, a gas-liquid separator 14 and an expansion device 16*c* are disposed. The other constituent elements are mounted in the sub relay unit 3*b*. The gas-liquid separator 14 is connected to the one refrigerant pipeline 4 connected to the outdoor unit 1 and the two refrigerant pipelines 4 connected to the heat exchanger related to heat medium 15*a* and the heat exchanger related to heat medium 15*b* of the sub relay unit 3*b* and separates the heat-source-side refrigerant supplied from the outdoor unit 1 into a vapor refrigerant and a liquid refrigerant. The expansion device 16*c* is disposed on the downstream side in the flow of the liquid refrigerant of the gas-liquid separator 14, has a function as a reducing valve or an expansion valve, reduces the pressure of and expands the heat-source-side refrigerant and is controlled so that the pressure state of the refrigerant on the outlet side of the expansion device 16*c* becomes an intermediate pressure in the cooling and heating mixed operation. The expansion device 16*c* is preferably formed of a device capable of variable control of the opening degree or an electronic expansion valve or the like, for example. By configuring the device as above, a plurality of the sub relay units 3*b* can be connected to the main relay unit 3*a*.

[Description of Operation Mode]

Each operation mode executed by the air-conditioning apparatus 100 will be described. This air-conditioning apparatus 100 is capable of performing a cooling operation or a heating operation with the indoor units 2 thereof on the basis of an instruction from each of the indoor units 2. That is, the air-conditioning apparatus 100 can perform the same operation with all the indoor units 2 and also can perform different operations with each of the indoor units 2. Since each operation mode executed by the air-conditioning apparatus 100A is the same, description of each of the operation modes executed by the air-conditioning apparatus 100A will be omitted.

The operation modes executed by the air-conditioning apparatus 100 include a cooling only operation mode in which all the running indoor units 2 perform a cooling operation, a heating only operation mode in which all the running indoor units 2 perform a heating operation, a cooling-main operation mode in which a cooling load is larger, and a heating-main operation mode in which a heating load is larger. Each of the operation modes will be described below by referring to the flow of the heat-source-side refrigerant and the heat medium.

[Cooling Only Operation Mode]

Figure 4:
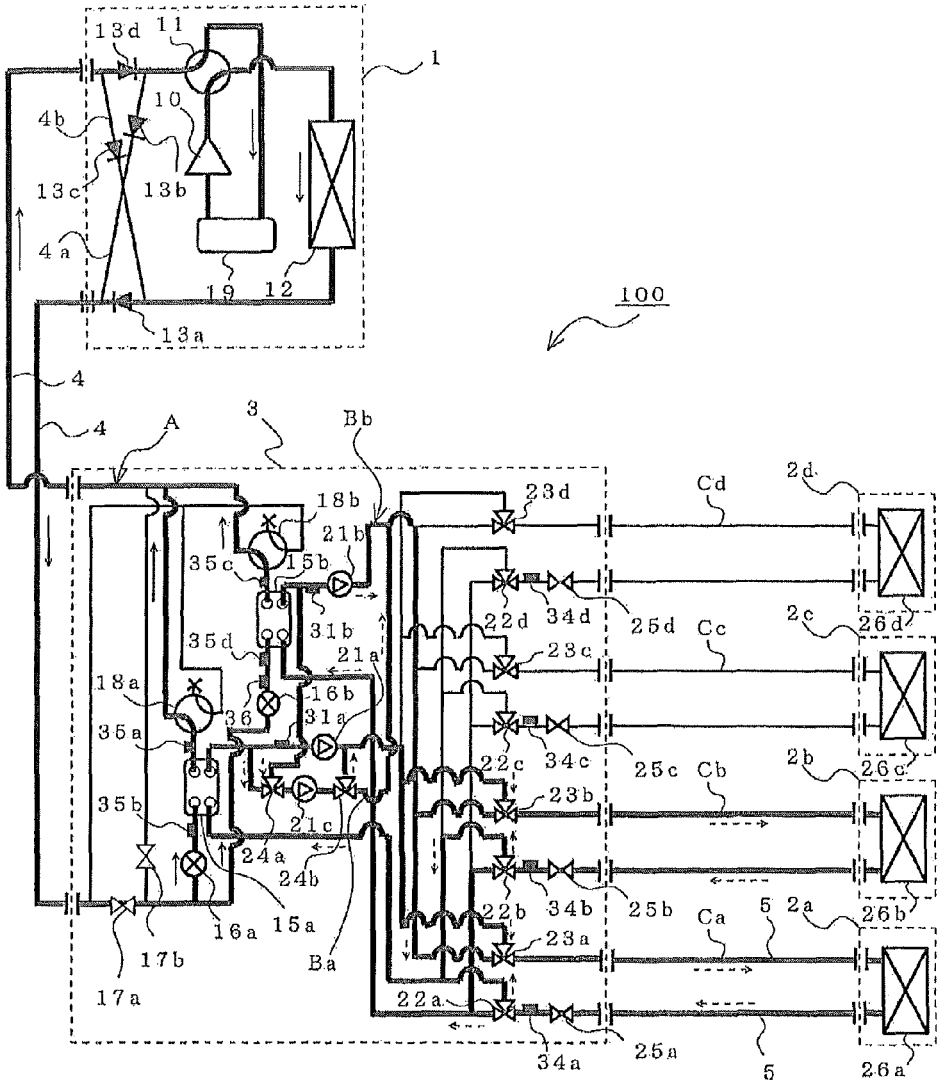
FIG. 4 is a refrigerant cycle diagram illustrating the flow of a refrigerant in a cooling only operation mode of the air-conditioning apparatus according to the embodiment of the present invention.

FIG. 4 is a refrigerant cycle diagram illustrating a flow of a refrigerant in the cooling only operation mode of the air-conditioning apparatus 100. In FIG. 4, the cooling only operation mode will be described using an example in which a cooling load is generated only in the use-side heat exchanger 26*a* and the use-side heat exchanger 26*b*. In FIG. 4, a pipeline expressed by a bold line indicates a pipeline through which the refrigerant (the heat-source side refrigerant and the heat medium) circulates. Also, in FIG. 4, the flow direction of the heat-source-side refrigerant is indicated by solid-line arrows, while the flow direction of the heat medium by broken-line arrows.

In the case of the cooling only operation mode shown in FIG. 4, in the outdoor unit 1, the first refrigerant flow direction switching device 11 is switched so that the heat-source-side refrigerant discharged from the compressor 10 flows into the heat-source-side heat exchanger 12.

In the relay unit 3, the pump 21*a*, the pump 21*b*, and the pump 21*c* are run. At this time, the pump flow direction switching device 24*a* adjusts the opening degree (an intermediate opening degree, for example) so as to communicate with the suction side of the pump 21*a* and the suction side of the pump 21*b*. That is, the opening degree of the pump flow direction switching device 24*a* is adjusted so that a channel through which the heat medium flows from the suction side of the pump 21*a* to the pump flow direction switching device 24*a* and a channel through which the heat medium flows from the suction side of the pump 21*b* to the pump flow direction switching device 24*a* are secured. The pump flow direction switching device 24*b* adjusts the opening degree (an intermediate opening degree, for example) so as to communicate with the discharge side of the pump 21*a* and the discharge side of the pump 21*b*. That is, the opening degree of the pump flow direction switching device 24*b* is adjusted so that a channel through which the heat medium flows from the pump flow direction switching device 24*b* to the discharge side of the pump 21*a* and a channel through which the heat medium flows from the pump flow direction switching device 24*b* to the discharge side of the pump 21*b* are secured.

Also, in the relay unit 3, the heat medium flow control device 25*a* and the heat medium flow control device 25*b* are opened, and the heat medium flow control device 25*c* and the heat medium flow control device 25*d* are closed so that the heat medium circulates between each of the heat exchanger related to heat medium 15*a* and the heat exchanger related to heat medium 15*b* and the use-side heat exchanger 26*a* and the use-side heat exchanger 26*b*. Also, the on-off device 17*a* is open, and the on-off device 17*b* is closed.

Firstly, the flow of the heat-source-side refrigerant in the refrigerant cycle A will be described.

A low-temperature and low-pressure refrigerant is compressed by the compressor 10 to become a high-temperature and high-pressure gas refrigerant and discharged. The high-temperature and high-pressure gas refrigerant discharged from the compressor 10 passes through the first refrigerant flow direction switching device 11 to flow into the heat-source-side heat exchanger 12. Then, the refrigerant is condensed and liquefied while dissipating heat into the outdoor air in the heat-source-side heat exchanger 12 and becomes a high-pressure liquid refrigerant. The high-pressure liquid refrigerant having flowed out of the heat-source-side heat exchanger 12 passes through the check valve 13*a* and flows out of the outdoor unit 1 and flows into the relay unit 3 via the refrigerant pipeline 4. The high-pressure liquid refrigerant having flowed into the relay unit 3 passes through the on-off device 17*a* and then, is branched and expanded by the expansion device 16*a* and the expansion device 16*b* and becomes a low-temperature and low-pressure two-phase refrigerant.

This two-phase refrigerant flows into the heat exchanger related to heat medium 15*a* and the heat exchanger related to heat medium 15*b*, which work as evaporators, respectively, and becomes a low-temperature and low-pressure gas refrigerant while cooling the heat medium by taking heat away from the heat medium circulating through the first heat medium channel 13 and the second heat medium channel C. The gas refrigerant having flowed out of the heat exchanger related to heat medium 15*a* and the heat exchanger related to heat medium 15*b* flows out of the relay unit 3 through the second refrigerant flow direction switching device 18*a* and the second refrigerant flow direction switching device 18*b* and flows into the outdoor unit 1 again through the refrigerant pipeline 4. The refrigerant having flowed into the outdoor unit 1 passes through the check valve 13*d* and is sucked into the compressor 10 again through the first refrigerant flow direction switching device 11 and the accumulator 19.

At this time, the opening degree of the expansion device 16*a* is controlled so that superheat (superheat degree) obtained as a difference between the temperature detected at the third temperature sensor 35*a* and the temperature detected at the third temperature sensor 35*b* becomes constant. Similarly, the opening degree is controlled so that superheat obtained as a difference between the temperature detected at the third temperature sensor 35*c* and the temperature detected at the third temperature sensor 35*d* becomes constant.

Subsequently, the flow of the heat medium in the first heat medium channel B and the second heat medium channel C will be described.

In the cooling only operation mode, cooling energy of the heat-source-side refrigerant is transmitted to the heat medium both in the heat exchanger related to heat medium 15*a* and the heat exchanger related to heat medium 15*b*, and the cooled heat medium is fluidized in the pipeline 5 by the pump 21*a*, the pump 21*b*, and the pump 21*c*. The heat medium having been pressurized and made to flow out by the pump 21*a*, the pump 21*b*, and the pump 21*c* flows into the use-side heat exchanger 26*a* and the use-side heat exchanger 26*b* through the second heat medium flow direction switching device 23*a* and the second heat medium flow direction switching device 23*b*. Then, by taking heat away from the indoor air in the use-side heat exchanger 26*a* and the use-side heat exchanger 26*b*, the heat medium performs cooling of the indoor space 7.

Then, the heat medium flows out of the use-side heat exchanger 26*a* and the use-side heat exchanger 26*b* and flows into the heat medium flow control device 25*a* and the heat medium flow control device 25*b*. At this time, by means of the action of the heat medium flow control device 25*a* and the heat medium flow control device 25*b*, the flow amount of the heat medium is controlled to a flow amount required to bear an air-conditioning load required in the room and flows into the use-side heat exchanger 26*a* and the use-side heat exchanger 26*b*. The heat medium having flowed out of the heat medium flow control device 25*a* and the heat medium flow control device 25*b* passes through the first heat medium flow direction switching device 22*a* and the first heat medium flow direction switching device 22*b*, flows into the heat exchanger related to heat medium 15*a* and the heat exchanger related to heat medium 15*b*, and is sucked into the pump 21*a*, the pump 21*b*, and the pump 21*c* again.

In the pipeline 5 of the use-side heat exchanger 26, the heat medium flows in the direction from the second heat medium flow direction switching device 23 to the first heat medium flow direction switching device 22 via the heat medium flow control device 25. Also, the air-conditioning load required in the indoor space 7 can covered by executing control such that the difference between the temperature detected by the first temperature sensor 31*a* or the temperature detected by first temperature sensor 31*b* and the temperature detected by the second temperature sensor 34 is kept at a target value. As the outlet temperature of the heat exchanger related to heat medium 15, either of the temperature of the first temperature sensor 31*a* or the first temperature sensor 31*b* may be used or an average temperature of them may be used. At this time, the first heat medium flow direction switching device 22 and the second heat medium flow direction switching device 23 are set to the intermediate opening degrees so that the channels to flow to the heat exchanger related to heat medium 15*a* and the heat exchanger related to heat medium 15*b* are both secured.

When the cooling only operation mode is to be executed, since there is no need to make the heat medium flow into the use-side-heat exchanger 26 (including thermo off) which does not have an air-conditioning load, the channel is closed by the heat medium flow control device 25 so that the heat medium does not flow into the use-side heat exchanger 26. In FIG. 4, since there is an air-conditioning load in the use-side heat exchanger 26*a* and the use-side heat exchanger 26*b*, the heat medium is made to flow, but there is no air-conditioning load in the use-side heat exchanger 26*c* and the use-side heat exchanger 26*d*, and the corresponding heat medium flow control device 25*c* and the heat medium flow control device 25*d* are fully closed. In the case of occurrence of an air-conditioning load from the use-side heat exchanger 26*c* or the use-side heat exchanger 26*d*, it is only necessary to open the heat medium flow control device 25*c* and the heat medium flow control device 25*d* so that the heat medium is circulated.

[Heating Only Operation Mode]

Figure 5:
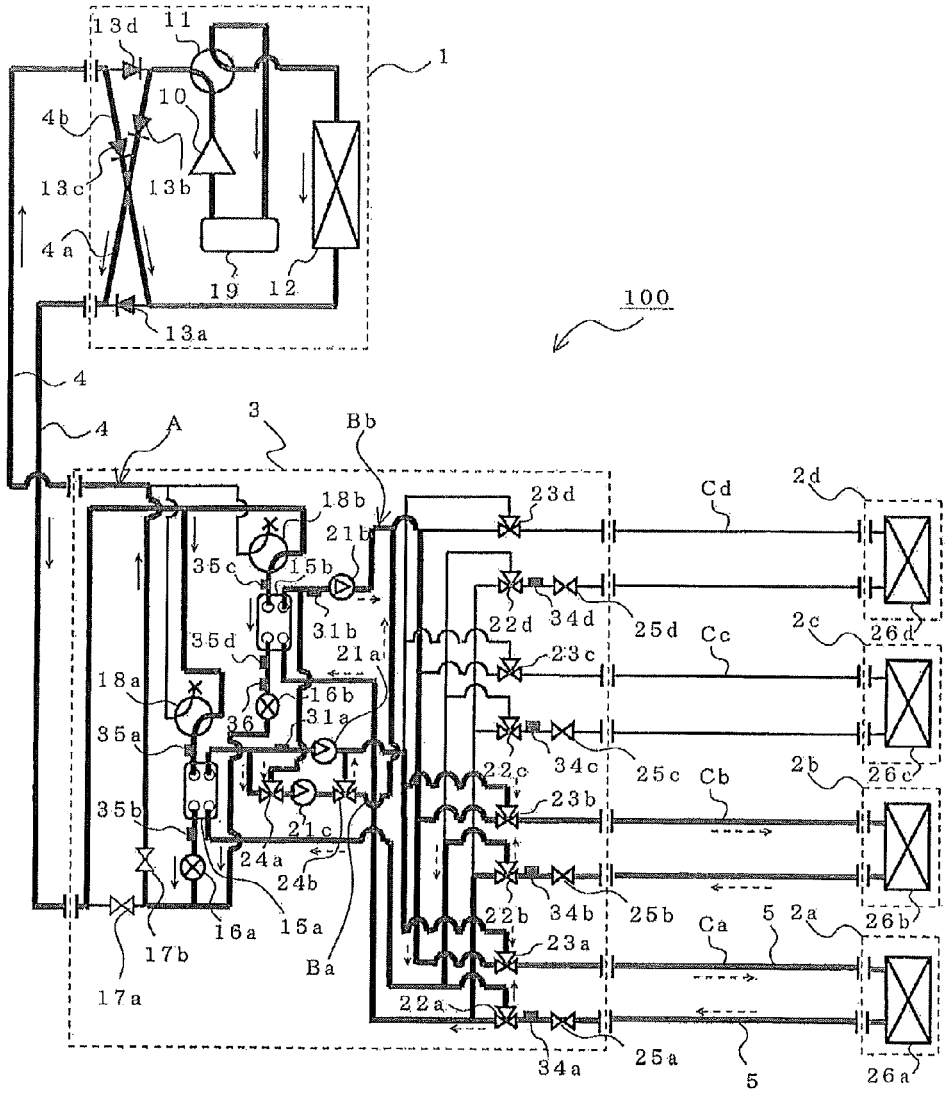
FIG. 5 is a refrigerant cycle diagram illustrating the flow of a refrigerant in a heating only operation mode of the air-conditioning apparatus according to the embodiment of the present invention.

FIG. 5 is a refrigerant cycle diagram illustrating a flow of a refrigerant in the heating only operation mode of the air-conditioning apparatus 100. In FIG. 5, the heating only operation mode will be described using an example in which a heating load is generated only in the use-side heat exchanger 26*a* and the use-side heat exchanger 26*b*. In FIG. 5, a pipeline expressed by a bold line indicates a pipeline through which the refrigerant (the heat-source side refrigerant and the heat medium) flows. Also, in FIG. 5, the flow direction of the heat-source-side refrigerant is indicated by solid-line arrows, while the flow direction of the heat medium by broken-line arrows.

In the case of the heating only operation mode shown in FIG. 5, in the outdoor unit 1, the first refrigerant flow direction switching device 11 is switched so that the heat-source-side refrigerant discharged from the compressor 10 flows into the relay unit 3 without passing through the heat-source-side heat exchanger 12.

Also, in the relay unit 3, the pump 21*a*, the pump 21*b*, and the pump 21*c* are run. At this time, the pump flow direction switching device 24*a* adjusts the opening degree (an intermediate opening degree, for example) so as to communicate with the suction side of the pump 21*a* and the suction side of the pump 21*b*. That is, the opening degree of the pump flow direction switching device 24*a* is adjusted so that a channel through which the heat medium flows from the suction side of the pump 21*a* to the pump flow direction switching device 24*a* and a channel through which the heat medium flows from the suction side of the pump 21*b* to the pump flow direction switching device 24*a* are secured. The pump flow direction switching device 24*b* adjusts the opening degree (an intermediate opening degree, for example) so as to communicate with the discharge side of the pump 21*a* and the discharge side of the pump 21*b*. That is, the opening degree of the pump flow direction switching device 24*b* is adjusted so that a channel through which the heat medium flows from the pump flow direction switching device 24*b* to the discharge side of the pump 21*a* and a channel through which the heat medium flows from the pump flow direction switching device 24*b* to the discharge side of the pump 21*b* are secured.

In the relay unit 3, the heat medium flow control device 25*a* and the heat medium flow control device 25*b* are opened, and the heat medium flow control device 25*c* and the heat medium flow control device 25*d* are closed so that the heat medium circulates between each of the heat exchanger related to heat medium 15*a* and the heat exchanger related to heat medium 15*b* and the use-side heat exchanger 26*a* and the use-side heat exchanger 26*b*. Also, the on-off device 17*a* is closed, and the on-off device 17*b* is opened.

First, the flow of the heat-source-side refrigerant in the refrigerant cycle A will be described.

A low-temperature and low-pressure refrigerant is compressed by the compressor 10, becomes a high-temperature and high-pressure gas refrigerant and is discharged. The high-temperature and high-pressure gas refrigerant discharged from the compressor 10 passes through the first refrigerant flow direction switching device 11, passes through the first connection pipeline 4*a* and the check valve 13*b* and flows out of the outdoor unit 1. The high-temperature and high-pressure gas refrigerant having flowed out of the outdoor unit 1 flows into the relay unit 3 through the refrigerant pipeline 4. The high-temperature and high-pressure gas refrigerant having flowed into the relay unit 3 is branched, passes through the second refrigerant flow direction switching device 18*a* and the second refrigerant flow direction switching device 18*b* and flows into each of the heat exchanger related to heat medium 15*a* and the heat exchanger related to heat medium 15*b*.

The high-temperature and high-pressure gas refrigerant having flowed into the heat exchanger related to heat medium 15*a* and the heat exchanger related to heat medium 15*b* is condensed and liquefied to turn into a high-pressure liquid refrigerant while dissipating heat into the heat medium circulating through the first heat medium channel B and the second heat medium channel C. The liquid refrigerant having flowed out of the heat exchanger related to heat medium 15*a* and the heat exchanger related to heat medium 15*b* is expanded by the expansion device 16*a* and the expansion device 16*b* and becomes a low-temperature and low-pressure two-phase refrigerant. This two-phase refrigerant passes through the on-off device 17*b*, flows out of the relay unit 3, and flows into the outdoor unit 1 again through the refrigerant pipeline 4. The refrigerant having flowed into the outdoor unit 1 passes through the second connection pipeline 4*b* and the check valve 13*c* and flows into the heat-source-side heat exchanger 12, which works as an evaporator.

Then, the refrigerant having flowed into the heat-source-side heat exchanger 12 absorbs heat from the outside air in the heat-source-side heat exchanger 12 and becomes a low-temperature and low-pressure gas refrigerant. The low-temperature and low-pressure gas refrigerant having flowed out of the heat-source-side heat exchanger 12 is sucked into the compressor 10 again through the first refrigerant flow direction switching device 11 and the accumulator 19.

At this time, the expansion device 16*a* has the opening degree thereof controlled so that subcool (subcool degree) obtained as a difference between a value obtained by converting the pressure detected by the pressure sensor 36 to a saturated temperature and the temperature detected by the third temperature sensor 35*b* becomes constant. Similarly, the expansion device 16*b* has the opening degree thereof controlled so that subcool obtained as a difference between a value obtained by converting the pressure detected by the pressure sensor 36 to a saturated temperature and the temperature detected by the third temperature sensor 35*d* becomes constant. If the temperature of an intermediate position of the heat exchanger related to heat medium 15 can be measured, the temperature at the intermediate position may be used instead of the pressure sensor 36, whereby a system can be configured inexpensively.

Subsequently, the flow of the heat medium in the first heat medium channel B and the second heat medium channel C will be described.

In the heating only operation mode, heating energy of the heat-source-side refrigerant is transmitted to the heat medium both in the heat exchanger related to heat medium 15*a* and the heat exchanger related to heat medium 15*b*, and the heated heat medium is fluidized in the pipeline 5 by the pump 21*a*, the pump 21*b*, and the pump 21*c*. The heat medium having been pressurized and made to flow out by the pump 21*a*, the pump 21*b*, and the pump 21*c* flows into the use-side heat exchanger 26*a* and the use-side heat exchanger 26*b* through the second heat medium flow direction switching device 23*a* and the second heat medium flow direction switching device 23*b*. Then, by dissipating heat into the indoor air in the use-side heat exchanger 26*a* and the use-side heat exchanger 26*b*, the heat medium performs heating of the indoor space 7.

Then, the heat medium flows out of the use-side heat exchanger 26*a* and the use-side heat exchanger 26*b* and flows into the heat medium flow control device 25*a* and the heat medium flow control device 25*b*. At this time, by means of the actions of the heat medium flow control device 25*a* and the heat medium flow control device 25*b*, the flow of the heat medium is controlled to a flow required to bear an air-conditioning load required in the room and flows into the use-side heat exchanger 26*a* and the use-side heat exchanger 26*b*. The heat medium having flowed out of the heat medium flow control device 25*a* and the heat medium flow control device 25*b* passes through the first heat medium flow direction switching device 22*a* and the first heat medium flow direction switching device 22*b*, flows into the heat exchanger related to heat medium 15*a* and the heat exchanger related to heat medium 15*b*, and is sucked into the pump 21*a*, the pump 21*b*, and the pump 21*c* again.

In the pipeline 5 of the use-side heat exchanger 26, the heat medium flows in the direction from the second heat medium flow direction switching device 23 to the first heat medium flow direction switching device 22 via the heat medium flow control device 25. Also, the air-conditioning load required in the indoor space 7 can be covered by executing control such that the difference between the temperature detected by the first temperature sensor 31*a* or the temperature detected by first temperature sensor 31*b* and the temperature detected by the second temperature sensor 34 is kept at a target value. As the outlet temperature of the heat exchanger related to heat medium 15, either of the temperature of the first temperature sensor 31*a* or the first temperature sensor 31*b* may be used or an average temperature of them may be used.

At this time, the first heat medium flow direction switching device 22 and the second heat medium flow direction switching device 23 are set to the intermediate opening degrees so that the channels to flow to the heat exchanger related to heat medium 15*a* and the heat exchanger related to heat medium 15*b* are both secured. Also, the use-side heat exchanger 26 should be controlled by the temperature difference between the inlet and the outlet thereof, but the heat medium temperature on the inlet side of the use-side heat exchanger 26 is substantially the same as the temperature detected by the first temperature sensor 31*b*, and by using the first temperature sensor 31*b*, the number of temperature sensors can be reduced, whereby the system can be configured inexpensively.

When the heating only operation mode is to be executed, since there is no need to make the heat medium flow into the use-side heat exchanger 26 (including thermo off) which does not have an air-conditioning load, the channel is closed by the heat medium flow control device 25 so that the heat medium does not flow into the use-side heat exchanger 26. In FIG. 5, since there is an air-conditioning load in the use-side heat exchanger 26*a* and the use-side heat exchanger 26*b*, the heat medium is made to flow, but there is no air-conditioning load in the use-side heat exchanger 26*c* and the use-side heat exchanger 26*d*, and the corresponding heat medium flow control device 25*c* and the heat medium flow control device 25*d* are fully closed. In the case of occurrence of an air-conditioning load from the use-side heat exchanger 26*c* or the use-side heat exchanger 26*d*, it is only necessary to open the heat medium flow control device 25*c* and the heat medium flow control device 25*d* so that the heat medium is circulated.

[Cooling-Main Operation Mode]

Figure 6:
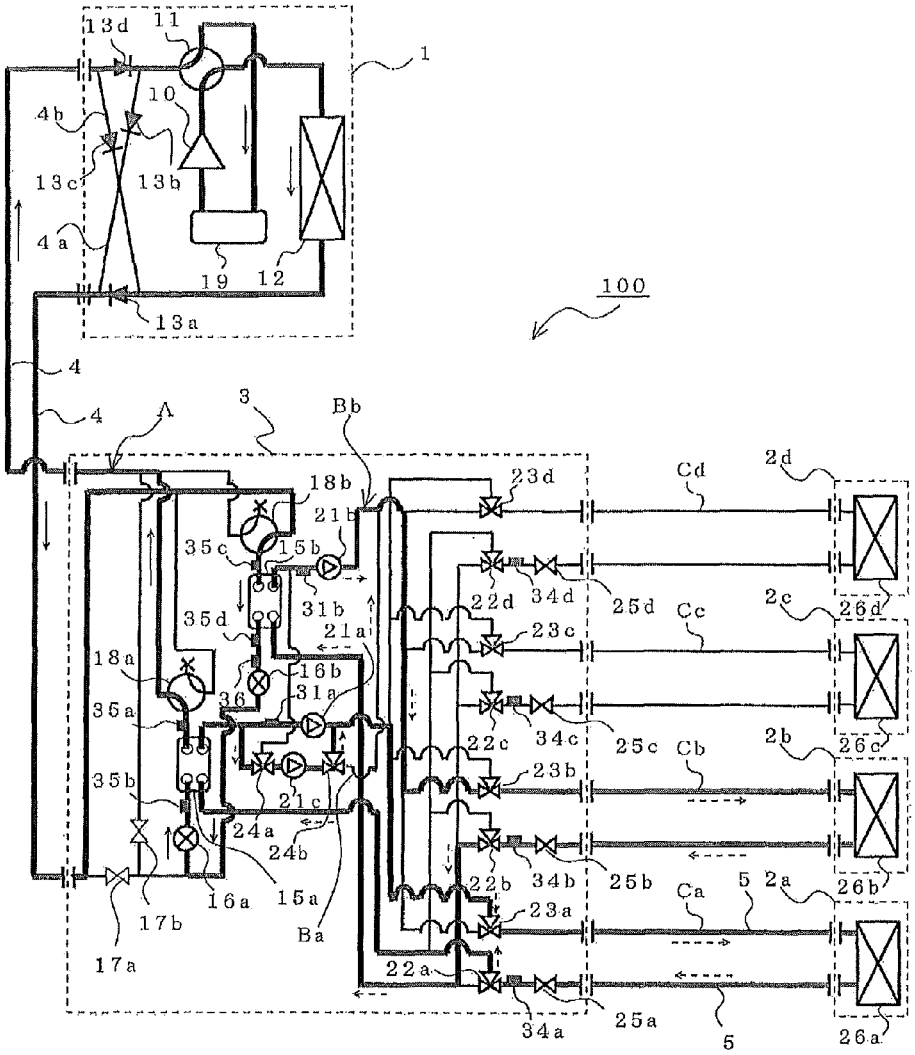
FIG. 6 is a refrigerant cycle diagram illustrating the flow of a refrigerant in a cooling-main operation mode of the air-conditioning apparatus according to the embodiment of the present invention.

FIG. 6 is a refrigerant cycle diagram illustrating the flow of the refrigerant during the cooling-main operation mode of the air-conditioning apparatus 100. In FIG. 6, using an example in which a cooling energy load is generated in the use-side heat exchanger 26*a* and a heating energy load is generated in the use-side heat exchanger 26*b*, the cooling-main operation mode will be described. In FIG. 6, the pipeline expressed by a bold line indicates a pipeline through which the refrigerant (heat-source side refrigerant and the heat medium) circulates. Also, in FIG. 6, the flow direction of the heat-source side refrigerant is indicated by a solid-line arrow, while the flow direction of the heat medium by broken-line arrows.

In the case of the cooling-main operation mode illustrated in FIG. 6, in the outdoor unit 1, the first refrigerant flow direction switching device 11 is switched so that the heat-source-side refrigerant discharged from the compressor 10 flows into the heat-source-side heat exchanger 12.

In the relay unit 3, the pump 21*a*, the pump 21*b*, and the pump 21*c* are run. At this time, the pump flow direction switching device 24*a* has the opening degree thereof adjusted so as to communicate with the suction side of the pump 21*a*. That is, the opening degree of the pump flow direction switching device 24*a* is adjusted so that a channel through which the heat medium flows from the suction side of the pump 21*a* to the pump flow direction switching device 24*a* is secured. The pump flow direction switching device 24*b* has the opening degree thereof adjusted so as to communicate with the discharge side of the pump 21*a*. That is, the opening degree of the pump flow direction switching device 24*b* is adjusted so that a channel through which the heat medium flows from the pump flow direction switching device 24*b* to the discharge side of the pump 21*a* is secured. That is, in the cooling-main operation mode having a larger cooling load, the heat medium used for cooling the indoor space 7 is circulated by the pump 21*a* and the pump 21*c*.

In the relay unit 3, the heat medium flow control device 25*a* and the heat medium flow control device 25*b* are opened, and the heat medium flow control device 25*c* and the heat medium flow control device 25*d* are closed so that the heat medium circulates between the heat exchanger related to heat medium 15*a* and the use-side heat exchanger 26*a* and between the heat exchanger related to heat medium 15*b* and the use-side heat exchanger 26*b*, respectively. Also, the on-off device 17*a* and the on-off device 17*b* are closed.

First, the flow of the heat-source-side refrigerant in the refrigerant cycle A will be described.

A low-temperature and low-pressure refrigerant is compressed by the compressor 10, becomes a high-temperature and high-pressure gas refrigerant and is discharged. The high-temperature and high-pressure gas refrigerant discharged from the compressor 10 passes through the first refrigerant flow direction switching device 11 and flows into the heat-source-side heat exchanger 12. Then, the refrigerant is condensed while dissipating heat into the outdoor air in the heat-source-side heat exchanger 12 and becomes a two-phase refrigerant. The two-phase refrigerant having flowed out of the heat-source-side heat exchanger 12 passes through the check valve 13*a* and flows out of the outdoor unit 1 and flows into the relay unit 3 via the refrigerant pipeline 4. The two-phase refrigerant having flowed into the relay unit 3 passes through the second refrigerant flow direction switching device 18*b* and flows into the heat exchanger related to heat medium 15*b*, which works as a condenser.

The two-phase refrigerant having flowed into the heat exchanger related to heat medium 15*b* is condensed and liquefied while dissipating heat into the heat medium circulating in the first heat medium channel B and the second heat medium channel C and becomes a liquid refrigerant. The liquid refrigerant having flowed out of the heat exchanger related to heat medium 15*b* is expanded by the expansion device 16*b* and becomes a low-pressure two-phase refrigerant. This low-pressure two-phase refrigerant flows into the heat exchanger related to heat medium 15*a*, which works as an evaporator, through the expansion device 16*a*. The low-pressure two-phase refrigerant having flowed into the heat exchanger related to heat medium 15*a* cools the heat medium by taking heat away from the heat medium circulating in the first heat medium channel B and the second heat medium channel C and becomes a low-pressure gas refrigerant. This gas refrigerant flows out of the heat exchanger related to heat medium 15*a*, flows out of the relay unit 3 through the second refrigerant flow direction switching device 18*a* and flows into the outdoor unit 1 again through the refrigerant pipeline 4. The refrigerant having flowed into the outdoor unit 1 passes through the check valve 13*d* and is sucked into the compressor 10 again through the first refrigerant flow direction switching device 11 and the accumulator 19.

At this time, the expansion device 16*b* has the opening degree thereof controlled so that superheat obtained as a difference between the temperature detected at the third temperature sensor 35*a* and the temperature detected at the third temperature sensor 35*b* becomes constant. Also, the expansion device 16*a* is fully open. The expansion device 16*b* may have the opening degree thereof controlled so that the subcool obtained as a difference between a value obtained by converting the pressure detected by the pressure sensor 36 to a saturated temperature and the temperature detected by the third temperature sensor 35*d* becomes constant. Also, such control may be made that the expansion device 16*b* is fully open, and superheat or subcool is controlled by the expansion device 16*a*.

Subsequently, the flow of the heat medium in the first heat medium channel B and the second heat medium channel C will be described.

In the cooling-main operation mode, heating energy of the heat-source-side refrigerant is transmitted to the heat medium in the heat exchanger related to heat medium 15*b*, and the heated heat medium is fluidized in the pipeline 5 by the pump 21*b*. Also, in the cooling-main operation mode, cooling energy of the heat-source-side refrigerant is transmitted to the heat medium in the heat exchanger related to heat medium 15*a*, and the cooled heat medium is fluidized in the pipeline 5 by the pump 21*a* and the pump 21*c*. The heat medium having been pressurized and made to flow out by the pump 21*b* flows into the use-side heat exchanger 26*b* through the second heat medium flow direction switching device 23*b*. The heat medium having been pressurized and made to flow out by the pump 21*a* and the pump 21*c* flows into the use-side heat exchanger 26*a* through the second heat medium flow direction switching device 23*a*.

By dissipating heat into the indoor air the indoor air in the use-side heat exchanger 26*b*, the heat medium performs heating of the indoor space 7. Also, by taking heat away from the indoor air in the use-side heat exchanger 26*a*, the heat medium performs cooling of the indoor space 7. At this time, the flow of the heat medium is controlled to a flow required to bear the air-conditioning load required in the room by means of the actions of the heat medium flow control device 25*a* and the heat medium flow control device 25*b* and flows into the use-side heat exchanger 26*a* and the use-side heat exchanger 26*b*. The heat medium having passed through the use-side heat exchanger 26*b* and has the temperature thereof lowered to some degree passes through the heat medium flow control device 25*b* and the first heat medium flow direction switching device 22*b*, flows into the heat exchanger related to heat medium 15*b* and is sucked into the pump 21*b* again. The heat medium having passed through the use-side heat exchanger 26*a* and has the temperature thereof raised to some degree passes through the heat medium flow control device 25*a* and the first heat medium flow direction switching device 22*a*, flows into the heat exchanger related to heat medium 15*a* and is sucked into the pump 21*a* and the pump 21*c* again.

During this period, the hot heat medium and the cold heat medium are not mixed with each other due to the actions of the first heat medium flow direction switching device 22 and the second heat medium flow direction switching device 23 and introduced to the use-side heat exchangers 26 having a heating load and a cooling load, respectively. In the pipeline 5 of the use-side heat exchanger 26, the heat medium flows in the direction from the second heat medium flow direction switching device 23 to the first heat medium flow direction switching device 22 through the heat medium flow control device 25 both on the heating side and the cooling side. Also, the air-conditioning load required in the indoor space 7 can be covered by executing control such that the difference between the temperature detected by the first temperature sensor 31*b* and the temperature detected by the second temperature sensor 34 on the heating side and the difference between the temperature detected by the second temperature sensor 34 and the temperature detected by the first temperature sensor 31*a* on the cooling side are kept at target values.

When the cooling-main operation mode is executed, since there is no need to make the heat medium flow into the use-side heat exchanger 26 (including thermo off) which does not have an air-conditioning load, the channel is closed by the heat medium flow control device 25 so that the heat medium does not flow into the use-side heat exchanger 26. In FIG. 6, since there is an air-conditioning load in the use-side heat exchanger 26*a* and the use-side heat exchanger 26*b*, the heat medium is made to flow, but there is no air-conditioning load in the use-side heat exchanger 26*c* and the use-side heat exchanger 26*d*, and the corresponding heat medium flow control device 25*c* and the heat medium flow control device 25*d* are fully closed. In the case of occurrence of an air-conditioning load from the use-side heat exchanger 26*c* or the use-side heat exchanger 26*d*, it is only necessary to open the heat medium flow control device 25*c* and the heat medium flow control device 25*d* so that the heat medium is circulated.

[Heating-Main Operation Mode]

Figure 7:
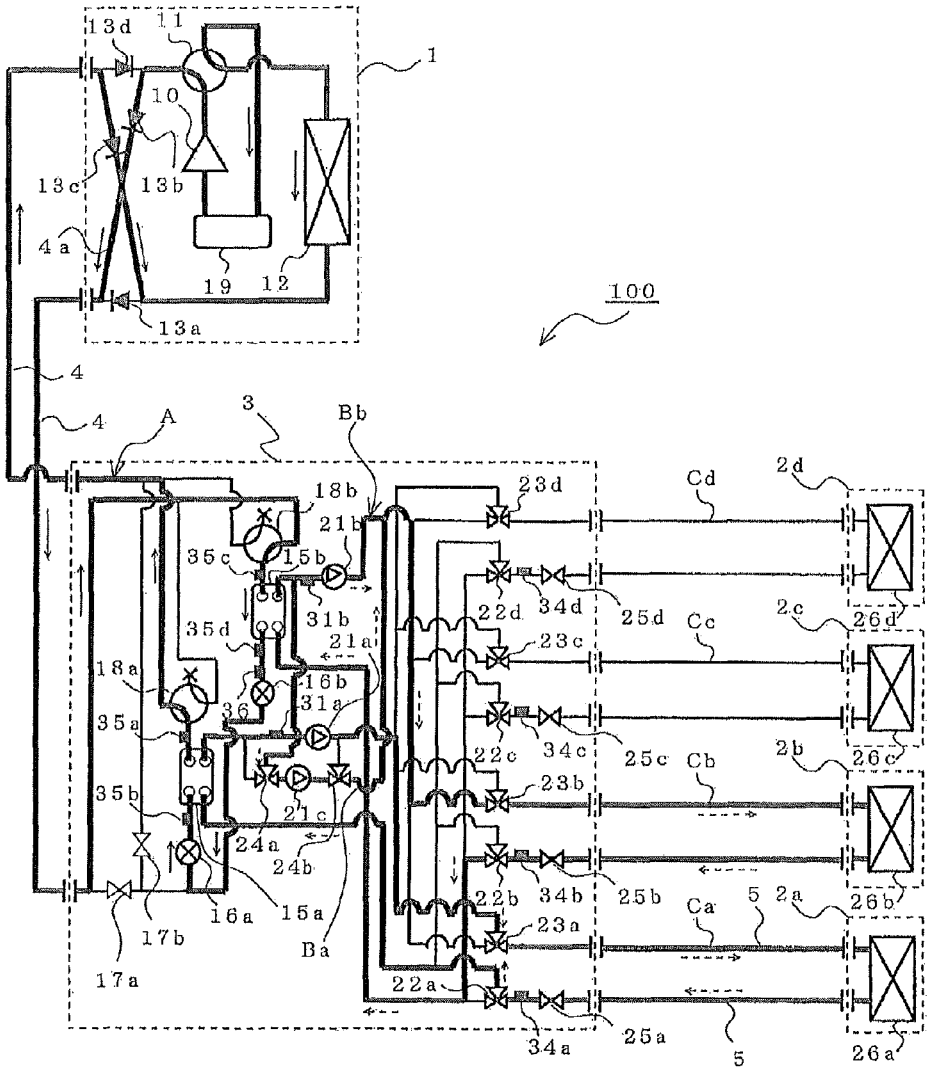
FIG. 7 is a refrigerant cycle diagram illustrating the flow of a refrigerant in a heating-main operation mode of the air-conditioning apparatus according to the embodiment of the present invention.

FIG. 7 is a refrigerant cycle diagram illustrating the flow of the refrigerant in the heating-main operation mode of the air-conditioning apparatus 100. In FIG. 7, using an example in which a cooling load is generated in the use-side heat exchanger 26*a* and a heating load is generated in the use-side heat exchanger 26*b*, the heating-main operation mode will be described. In FIG. 7, the pipeline expressed by a bold line indicates a pipeline through which the refrigerant (heat-source side refrigerant and the heat medium) circulates. Also, in FIG. 7, the flow direction of the heat-source side refrigerant is indicated by a solid-line arrow, while the flow direction of the heat medium by broken-line arrows.

In the case of the heating-main operation mode illustrated in FIG. 7, in the outdoor unit 1, the first refrigerant flow direction switching device 11 is switched so that the heat-source-side refrigerant discharged from the compressor 10 flows into the relay unit 3 without passing through the heat-source-side heat exchanger 12.

In the relay unit 3, the pump 21*a*, the pump 21*b*, and the pump 21*c* are run. At this time, the pump flow direction switching device 24*a* has the opening degree thereof adjusted so as to communicate with the suction side of the pump 21*b*. That is, the opening degree of the pump flow direction switching device 24*a* is adjusted so that a channel through which the heat medium flows from the suction side of the pump 21*b* to the pump flow direction switching device 24*a* is secured. The pump flow direction switching device 24*b* has the opening degree thereof adjusted so as to communicate with the discharge side of the pump 21*b*. That is, the opening degree of the pump flow direction switching device 24*b* is adjusted so that a channel through which the heat medium flows from the pump flow direction switching device 24*b* to the discharge side of the pump 21*b* is secured. That is, in the heating-main operation mode having a larger heating load, the heat medium used for heating the indoor space 7 is circulated by the pump 21*a* and the pump 21*c*.

In the relay unit 3, the heat medium flow control device 25*a* and the heat medium flow control device 25*b* are opened, and the heat medium flow control device 25*c* and the heat medium flow control device 25*d* are closed so that the heat medium circulates between the heat exchanger related to heat medium 15*a* and the use-side heat exchanger 26*a* and between the heat exchanger related to heat medium 15*b* and the use-side heat exchanger 26*b*, respectively. Also, the on-off device 17*a* and the on-off device 17*b* are closed.

First, the flow of the heat-source-side refrigerant in the refrigerant cycle A will be described.

A low-temperature and low-pressure refrigerant is compressed by the compressor 10, becomes a high-temperature and high-pressure gas refrigerant and is discharged. The high-temperature and high-pressure gas refrigerant discharged from the compressor 10 passes through the first refrigerant flow direction switching device 11, flows through the first connection pipeline 4*a*, passes through the check valve 13*b* and flows out of the outdoor unit 1. The high-temperature and high-pressure gas refrigerant having flowed out of the outdoor unit 1 flows into the relay unit 3 through the refrigerant pipeline 4. The high-temperature and high-pressure gas refrigerant having flowed into the relay unit 3 passes through the second refrigerant flow direction switching device 18*b* and flows into the heat exchanger related to heat medium 15*b*, which works as a condenser.

The gas refrigerant having flowed into the heat exchanger related to heat medium 15*b* is condensed and liquefied while dissipating heat into the heat medium circulating in the first heat medium channel B and the second heat medium channel C and becomes a liquid refrigerant. The liquid refrigerant having flowed out of the heat exchanger related to heat medium 15*b* is expanded by the expansion device 16*b* and becomes a low-pressure two-phase refrigerant. This low-pressure two-phase refrigerant flows into the heat exchanger related to heat medium 15*a*, which works as an evaporator, through the expansion device 16*a*. The low-pressure two-phase refrigerant having flowed into the heat exchanger related to heat medium 15*a* absorbs heat from the heat medium circulating in the first heat medium channel B and the second heat medium channel C and evaporates and cools the heat medium. This low-pressure two-phase refrigerant flows out of the heat exchanger related to heat medium 15*a*, flows out of the relay unit 3 through the second refrigerant flow direction switching device 18*a* and flows into the outdoor unit 1 again through the refrigerant pipeline 4.

The refrigerant having flowed into the outdoor unit 1 passes through the check valve 13*c* and flows into the heat-source-side heat exchanger 12, which works as an evaporator. The refrigerant having flowed into the heat-source-side heat exchanger 12 absorbs heat from the outdoor air in the heat-source-side heat exchanger 12 to turn into a low-temperature and low-pressure gas refrigerant. The low-temperature and low-pressure gas refrigerant having flowed out of the heat-source-side heat exchanger 12 is sucked into the compressor 10 again through the first refrigerant flow direction switching device 11 and the accumulator 19.

At this time, the expansion device 16*b* has the opening degree thereof controlled so that subheat obtained as a difference between the value obtained by converting the pressure detected by the pressure sensor 36 to a saturated temperature and the temperature detected at the third temperature sensor 35*b* becomes constant. Also, the expansion device 16*a* is fully open. Such control may be executed that the expansion device 16*b* is fully open, and subcool is controlled by the expansion device 16*a*.

Subsequently, the flow of the heat medium in the first heat medium channel B and the second heat medium channel C will be described.

In the heating-main operation mode, heating energy of the heat-source-side refrigerant is transmitted to the heat medium in the heat exchanger related to heat medium 15*b*, and the heated heat medium is fluidized in the pipeline 5 by the pump 21*b* and the pump 21*c*. Also, in the heating-main operation mode, cooling energy of the heat-source-side refrigerant is transmitted to the heat medium in the heat exchanger related to heat medium 15*a*, and the cooled heat medium is fluidized in the pipeline 5 by the pump 21*a*. The heat medium having been pressurized and made to flow out by the pump 21*b* and the pump 21*c* flows into the use-side heat exchanger 26*b* through the second heat medium flow direction switching device 23*b*. The heat medium having been pressurized and made to flow out by the pump 21*a* flows into the use-side heat exchanger 26*a* through the second heat medium flow direction switching device 23*a*.

By dissipating heat into the indoor air in the use-side heat exchanger 26*b*, the heat medium performs heating of the indoor space 7. Also, by taking heat away from the indoor air in the use-side heat exchanger 26*a*, the heat medium performs cooling of the indoor space 7. At this time, the flow of the heat medium is controlled to a flow required to bear the air-conditioning load required in the room by means of the actions of the heat medium flow control device 25*a* and the heat medium flow control device 25*b* and flows into the use-side heat exchanger 26*a* and the use-side heat exchanger 26*b*. The heat medium having passed through the use-side heat exchanger 26*b* and has the temperature thereof lowered to some degree passes through the heat medium flow control device 25*b* and the first heat medium flow direction switching device 22*b*, flows into the heat exchanger related to heat medium 15*b* and is sucked into the pump 21*b* and the pump 21*c* again. The heat medium having passed through the use-side heat exchanger 26*a* and has the temperature thereof raised to some degree passes through the heat medium flow control device 25*a* and the first heat medium flow direction switching device 22*a*, flows into the heat exchanger related to heat medium 15*a* and is sucked into the pump 21*a* again.

During this period, the hot heat medium and the cold heat medium are not mixed with each other due to the actions of the first heat medium flow direction switching device 22 and the second heat medium flow direction switching device 23 and introduced to the use-side heat exchangers 26 having a heating load and a cooling load, respectively. In the pipeline 5 of the use-side heat exchanger 26, the heat medium flows in the direction from the second heat medium flow direction switching device 23 to the first heat medium flow direction switching device 22 through the heat medium flow control device 25 both on the heating side and the cooling side. Also, the air-conditioning load required in the indoor space 7 can be covered by executing control such that the difference between the temperature detected by the first temperature sensor 31*b* and the temperature detected by the second temperature sensor 34 on the heating side and the difference between the temperature detected by the second temperature sensor 34 and the temperature detected by the first temperature sensor 31*a* on the cooling side are kept at target values.

When the heating-main operation mode is executed, since there is no need to make the heat medium flow into the use-side heat exchanger 26 (including thermo off) which does not have an air-conditioning load, the channel is closed by the heat medium flow control device 25 so that the heat medium does not flow into the use-side heat exchanger 26. In FIG. 7, since there is an air-conditioning load in the use-side heat exchanger 26*a* and the use-side heat exchanger 26*b*, the heat medium is made to flow, but there is no air-conditioning load in the use-side heat exchanger 26*c* and the use-side heat exchanger 26*d*, and the corresponding heat medium flow control device 25*c* and the heat medium flow control device 25*d* are fully closed. In the case of occurrence of an air-conditioning load from the use-side heat exchanger 26*c* or the use-side heat exchanger 26*d*, it is only necessary to open the heat medium flaw control device 25*c* and the heat medium flow control device 25*d* so that the heat medium is circulated.

[Description of Operation of Pump 21*c*, pump Flow Direction Switching Device 24*a*, and Pump Flow Direction Switching Device 24*b*]

Subsequently, by using FIG. 8, the detailed operations of the pump 21*c*, the pump flow direction switching device 24*a*, and the pump flow direction switching device 24*b* will be described.

Figure 8:
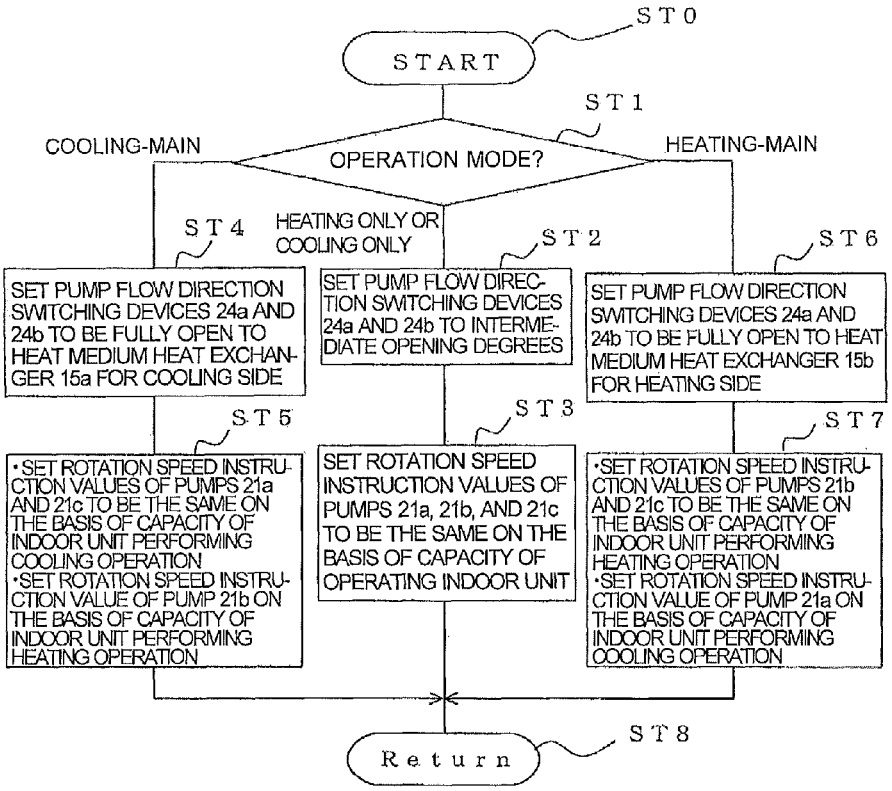
FIG. 8 is a flowchart illustrating detailed operations of a pump 21*c*, a pump flow direction switching device 24*a*, and a pump flow direction switching device 24*b* of the air-conditioning apparatus according to the embodiment of the present invention.

FIG. 8 is a flowchart illustrating the detailed operations of the pump 21*c*, the pump flow direction switching device 24*a*, and the pump flow direction switching device 24*b*.

If the operation of the air-conditioning apparatus 100 is started, for example, control illustrated in the flowchart in FIG. 8 is started. If the operation of the air-conditioning apparatus 100 is started, for example (ST 0), the operation mode is recognized (ST 1).

If the operation mode is the heating only operation or the cooling only operation, the pump flow direction switching device 24*a* and the pump flow direction switching device 24*b* are set to intermediate opening degrees, for example (ST 2) so that both the first heat medium channel Ba and the first heat medium channel Bb communicate with the pump 21*c*. Then, on the basis of the capacity of the operated indoor unit 2, rotating speed instruction values of the pump 21*a*, the pump 21*b*, and the pump 21*c* are set to the same value (ST 3), and the flowchart is exited (ST 8). In the case of the embodiment, all the heat medium channels are made to communicate in the heating only operation or the cooling only operation. Thus, either of the first heat medium channel Ba or the first heat medium channel Bb may be made to communicate with the pump 21*c*.

When the operation mode is the cooling-main operation, the cooling load is larger than the heating load. Thus, the opening degrees of the pump flow direction switching device 24*a* and the pump flow direction switching device 24*b* are adjusted so that the first heat medium channel Ba through which the heat medium used for cooling flows communicates with the pump 21*c*. For example, the opening degrees of the pump flow direction switching device 24*a* and the pump flow direction switching device 24*b* are fully opened to the first heat medium channel Ba side (the heat exchanger related to heat medium 15*a* side) (ST 4). Then, on the basis of the capacity of the cooling-operation indoor unit 2, the rotation speed instruction values of the pump 21*a* and the pump 21*c* are set to the same value. Also, on the basis of the capacity of the heating-operation indoor unit, the rotation speed instruction value of the pump 21*b* is set (ST 5). After that, the flowchart is exited (ST 8).

When the operation mode is the heating-main operation, the heating load is larger than the cooling load. Thus, the opening degrees of the pump flow direction switching device 24*a* and the pump flow direction switching device 24*b* are adjusted so that the first heat medium channel Bb through which the heat medium used for heating flows communicates with the pump 21*c*. For example, the opening degrees of the pump flow direction switching device 24*a* and the pump flow direction switching device 24*b* are fully opened to the first heat medium channel Bb side (the heat exchanger related to heat medium 15*b* side) (ST 6). Then, on the basis of the capacity of the heating-operation indoor unit 2, the rotation speed instruction values of the pump 21*b* and the pump 21*c* are set to the same value. Also, on the basis of the capacity of the cooling-operation indoor unit, the rotation speed instruction value of the pump 21*b* is set (ST 7). After that, the flowchart is exited (ST 8).

By controlling as above, the pump 21*c* can be used for press feed of the heat medium flowing through the heat medium channel of the indoor unit 2 having a large air-conditioning load in response to the load balance between the heating load and the cooling load. Thus, regardless of the operation mode, appropriate capacities can be reliably exerted, and energy-saving of the air-conditioning apparatus 100 can be realized.

Also, by setting the rotation speed instruction values of the pump 21*c* and the pump 21 disposed in the heat medium channel with which this pump 21*c* communicates to the same value, these pumps can be considered as the same pump, and the similar control to that of the air-conditioning apparatus in which the pump 21*c* is not disposed can be used.

Also, in the cooling only operation mode and the heating only operation mode, in the air-conditioning apparatus 100, the first heat medium flow direction switching device 22 and the second heat medium flow direction switching device 23 corresponding to the indoor units 2 in operation to intermediate opening degrees so that the heat medium flows both to the heat exchanger related to heat medium 15*a* and the heat exchanger related to heat medium 15*b*. As a result, since both the heat exchanger related to heat medium 15*a* and the heat exchanger related to heat medium 15*b* can be used for the heating operation or the cooling operation, a heat transfer area is enlarged, and efficient heating operation or cooling operation can be performed.

Also, when the heating load and the cooling load are generated in a mixed manner in the use-side heat exchangers 26, the first heat medium flow direction switching device 22 and the second heat medium flow direction switching device 23 corresponding to the use-side heat exchanger 26 performing the heating operation are switched to the channel connected to the heat exchanger related to heat medium 15*b* for heating, while the first heat medium flow direction switching device 22 and the second heat medium flow direction switching device 23 corresponding to the use-side heat exchanger 26 performing the cooling operation are switched to the channel connected to the heat exchanger related to heat medium 15*a* for cooling, whereby the heating operation and the cooling operation can be performed freely in each of the indoor units 2.

Figure 9:
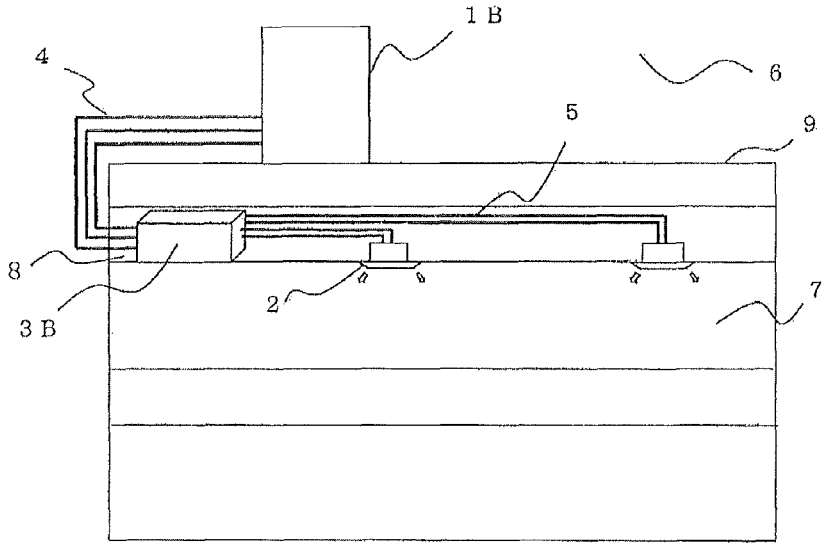
FIG. 9 is a schematic diagram illustrating an example of installation of the air-conditioning apparatus according to the embodiment of the present invention.
Figure 10:
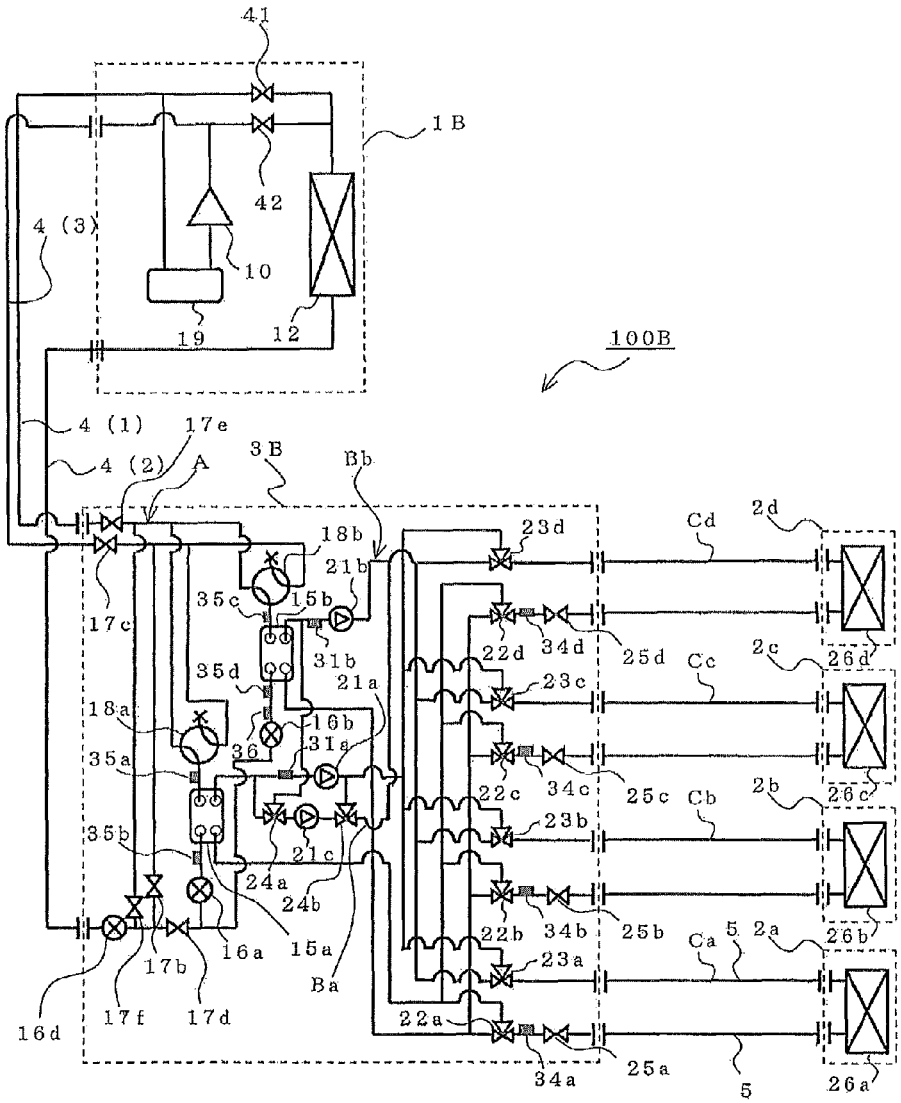
FIG. 10 is a schematic circuit configuration diagram illustrating still another example of a circuit configuration of the air-conditioning apparatus according to the embodiment of the present invention.

Moreover, the air-conditioning apparatus according to the embodiment may be configured such that an outdoor unit (hereinafter referred to as an outdoor unit 1B) as illustrated in FIG. 10 and a relay unit (hereinafter referred as a relay unit 3B) are connected by three refrigerant pipelines 4 (a refrigerant pipeline 4(1), a refrigerant pipeline 4(2), and a refrigerant pipeline 4(3)) (hereinafter referred to as an air-conditioning apparatus 100B). In FIG. 9, an example of installation of the air-conditioning apparatus 100B is illustrated. That is, the air-conditioning apparatus 1008 can also perform the same operation with all the indoor units 2 and can perform different operations in each of the indoor units 2. Also, in the refrigerant pipeline 4(2) in the relay unit 3B, an expansion device 16*d* (an electronic expansion valve or the like, for example) for merging of high-pressure liquids in the cooling-main operation mode is disposed.

The basic configuration of the air-conditioning apparatus 100B is the same as that of the air-conditioning apparatus 100, but the configurations of the outdoor unit 1B and the relay unit 3B are somewhat different. In the outdoor unit 1B, the compressor 10, the heat-source-side heat exchanger 12, the accumulator 19, and two flow direction switching sections (a flow direction switching section 41 and a flow direction switching section 42) are mounted. In the relay unit 3B, the on-off device 17*a* and the refrigerant pipeline branching the refrigerant pipeline 4 to connect to the second refrigerant flow direction switching device 18*b* are not provided but instead, an on-off device 17*c* and an on-off device 17*d* are disposed, and a branch pipeline in which the on-off device 17*b* is disposed is connected to the refrigerant pipeline 4(3). Also, in the relay unit 3B, a branch pipeline which connects the refrigerant pipeline 4(1) and the refrigerant pipeline 4(2), an on-off device 17*e*, and an o-off device 17*f* are disposed.

The refrigerant pipeline 4(3) connects a discharge pipeline of the compressor 10 and the relay unit 3B. Each of the two flow direction switching sections is formed of two-way valve and the like and opens/closes the refrigerant pipeline 4. The flow direction switching section 41 is disposed between a suction pipeline of the compressor 10 and the heat-source-side heat exchanger 12 and switches the flow of the heat source unit refrigerant by means of opening and closing control. The flow direction switching section 42 is disposed between a discharge pipeline of the compressor 10 and the heat-source-side heat exchanger 12 and switches the flow of the heat source unit refrigerant by means of opening and closing control.

Each of the on-off device 170 to the on-off device 17*f* is formed of a two-way valve and the like and opens/closes the refrigerant pipeline 4. The on-off device 17*c* is disposed in the refrigerant pipeline 4(3) in the relay unit 3B and opens/closes the refrigerant pipeline 4(3). The on-off device 17*d* is disposed in the refrigerant pipeline 4(2) in the relay unit 3B and opens/closes the refrigerant pipeline 4(2). The on-off device 17*e* is disposed in the refrigerant pipeline 4(1) in the relay unit 3B and opens/closes the refrigerant pipeline 4(1). The on-off device 17*f* is disposed in a branch pipeline which connects the refrigerant pipeline 4(1) and the refrigerant pipeline 4(2) in the relay unit 3B and opens/closes the branch pipeline. By means of the on-off device 17*e* and the on-off device 17*f*, inflow of the refrigerant into the heat-source-side heat exchanger 12 in the outdoor unit 1B is made possible.

Each of the operation modes executed by the air-conditioning apparatus 100B will be briefly described below on the basis of FIG. 10. Since the flows of the heat mediums in the first heat medium channel B and the second heat medium channel C are the same as those in the air-conditioning apparatus 100, the description will be omitted.

[Cooling Only Operation Mode]

In this cooling only operation mode, the flow direction switching section 41 is controllably closed, the flow direction switching section 42 is controllably open, the on-off device 17*b* is controllably closed, the on-off device 17*c* is controllably closed, the on-off device 17*d* is controllably open, the on-off device 17*e* is controllably open, and the on-off device 17*f* is controllably closed, respectively.

A low-temperature and low-pressure refrigerant is compressed by the compressor 10, becomes a high-temperature and high-pressure gas refrigerant and is discharged. The whole of the high-temperature and high-pressure gas refrigerant discharged from the compressor 10 flows into the heat-source-side heat exchanger 12 through the flow direction switching section 42. Then, while dissipating heat into the outside air in the heat-source-side heat exchanger 12, the refrigerant is condensed and liquefied and becomes a high-pressure liquid refrigerant. The high-pressure liquid refrigerant having flowed out of the heat-source-side heat exchanger 12 flows into the relay unit 3B through the refrigerant pipeline 4(2). The high-pressure liquid refrigerant having flowed into the relay unit 3B is branched and is expanded by the expansion device 16*a* and the expansion device 16*b* and becomes a low-temperature and low-pressure two-phase refrigerant.

This two-phase refrigerant flows into the heat exchanger related to heat medium 15*a* and the heat exchanger related to heat medium 15*b*, which work as evaporators, respectively, and by taking heat away from the heat medium circulating through the first heat medium channel Ba and the first heat medium channel Bb, the refrigerant becomes a low-temperature and low-pressure gas refrigerant while cooling the heat medium. The gas refrigerants having flowed out of the heat exchanger related to heat medium 15*a* and the heat exchanger related to heat medium 15*b* merge with each other after passing through the second refrigerant flow direction switching device 18*a* and the second refrigerant flow direction switching device 18*b*, pass through the on-off device 17*e* and flows out of the relay unit 3B and flows into the outdoor unit 1B again through the refrigerant pipeline 4(1). The refrigerant having flowed into the outdoor unit 1B is sucked into the compressor 10 again through the accumulator 19.

[Heating Only Operation Mode]

In this heating only operation mode, the flow direction switching section 41 is controllably open, the flow direction switching section 42 is controllably closed, the on-off device 17*b* is controllably closed, the on-off device 17*c* is controllably open, the on-off device 17*d* is controllably open, the on-off device 17*e* is controllably closed, and the on-off device 17*f* is controllably closed, respectively.

A low-temperature and low-pressure refrigerant is compressed by the compressor 10, becomes a high-temperature and high-pressure gas refrigerant and is discharged. The whole of the high-temperature and high-pressure gas refrigerant discharged from the compressor 10 passes through the refrigerant pipeline 4(3) and flows out of the outdoor unit 1B. The high-temperature and high-pressure gas refrigerant having flowed out of the outdoor unit 1B passes through the refrigerant pipeline 4(3) and flows into the relay unit 3B. The high-temperature and high-pressure gas refrigerant having flowed into the relay unit 3B branches and passes through the second refrigerant flow direction switching device 18*a* and the second refrigerant flow direction switching device 18*b* and flows into the heat exchanger related to heat medium 15*a* and the heat exchanger related to heat medium 15*b*, respectively.

The high-temperature and high-pressure gas refrigerant having flowed into the heat exchanger related to heat medium 15*a* and the heat exchanger related to heat medium 15*b* is condensed and liquefied while dissipating heat into the heat medium circulating through the first heat medium channel Ba and the first heat medium channel Bb and becomes a high-pressure liquid refrigerant. The liquid refrigerant having flowed out of the heat exchanger related to heat medium 15*a* and the heat exchanger related to heat medium 15*b* is expanded by the expansion device 16*a* and the expansion device 16*b* and becomes a low-temperature and low-pressure two-phase refrigerant. This two-phase refrigerant passes through the on-off device 17*d*, flows out of the relay unit 3B and flows into the outdoor unit 1B again through the refrigerant pipeline 4(2).

The refrigerant having flowed into the outdoor unit 1B flows into the heat-source-side heat exchanger 12, which works as an evaporator. Then, the refrigerant having flowed into the heat-source-side heat exchanger 12 absorbs heat from the outdoor air in the heat-source-side heat exchanger 12 and becomes a low-temperature and low-pressure gas refrigerant. The low-temperature and low-pressure gas refrigerant having flowed out of the heat-source-side heat exchanger 12 is sucked into the compressor 10 again through the flow direction switching section 41 and the accumulator 19.

[Cooling-Main Operation Mode]

Here, the cooling-main operation mode will be described using an example in which a cooling load is generated in the use-side heat exchanger 26*a* and a heating load is generated in the use-side heat exchanger 26*b*. In this cooing-main operation mode, the flow direction switching section 41 is controllably closed, the flow direction switching section 42 is controllably open, the on-off device 17*b* is controllably open, the on-off device 17*c* is controllably closed, the on-off device 17*d* is controllably closed, the on-off device 17*e* is controllably open, and the on-off device 17*f* is controllably closed, respectively.

A low-temperature and low-pressure refrigerant is compressed by the compressor 10, becomes a high-temperature and high-pressure gas refrigerant and is discharged. The whole of the high-temperature and high-pressure gas refrigerant discharged from the compressor 10 flows into the heat-source-side heat exchanger 12 through the flow direction switching section 42. Then, while dissipating heat into the outside air in the heat-source-side heat exchanger 12, the refrigerant is condensed and becomes a two-phase refrigerant. The two-phase refrigerant having flowed out of the heat-source-side heat exchanger 12 flows into the relay unit 3B through the refrigerant pipeline 4(2). The two-phase refrigerant having flowed into the relay unit 3B passes through the on-off device 17*b* and the second refrigerant flow direction switching device 18*b* and flows into the heat exchanger related to heat medium 15*b*, which works as a condenser.

The two-phase refrigerant having flowed into the heat exchanger related to heat medium 15*b* is condensed and liquefied while dissipating heat into the heat medium circulating in the first heat medium channel Bb and becomes a liquid refrigerant. The liquid refrigerant having flowed out of the heat exchanger related to heat medium 15*b* is expanded by the expansion device 16*b* and becomes a low-pressure two-phase refrigerant. This low-pressure two-phase refrigerant flows into the heat exchanger related to heat medium 15*a*, which works as an evaporator, through the expansion device 16*a*. The low-pressure two-phase refrigerant having flowed into the heat exchanger related to heat medium 15*a* absorbs heat from the heat medium circulating in the first heat medium channel Ba and becomes a low-pressure gas refrigerant while cooling the heat medium. This gas refrigerant flows out of the heat exchanger related to heat medium 15*a*, flows out of the relay unit 3B through the second refrigerant flow direction switching device 18*a* and the on-off device 17*e* and flows into the outdoor unit 1B again through the refrigerant pipeline 4(1). The refrigerant having flowed into the outdoor unit 1B is sucked into the compressor 10 again through the accumulator 19.

[Heating-Main Operation Mode]

Here, the heating-main operation mode will be described using an example in which a cooling load is generated in the use-side heat exchanger 26*a* and a heating load is generated in the use-side heat exchanger 26*b*. In this heating-main operation mode, the flow direction switching section 41 is controllably open, the flow direction switching section 42 is controllably closed, the on-off device 17*b* is controllably closed, the on-off device 17*c* is controllably open, the on-off device 17*d* is controllably closed, the on-off device 17*e* is controllably closed, and the on-off device 17*f* is controllably open, respectively.

A low-temperature and low-pressure refrigerant is compressed by the compressor 10, becomes a high-temperature and high-pressure gas refrigerant and is discharged. The whole of the high-temperature and high-pressure gas refrigerant discharged from the compressor 10 passes through the refrigerant pipeline 4(3) and flows out of the outdoor unit 18. The high-temperature and high-pressure gas refrigerant having flowed out of the outdoor unit 1B passes through the refrigerant pipeline 4(3) and flows into the relay unit 3B. The high-temperature and high-pressure gas refrigerant having flowed into the relay unit 3B passes through the on-off device 17*c* and the second refrigerant flow direction switching device 18*b* and flows into the heat exchanger related to heat medium 15*b*, which works as a condenser.

The gas refrigerant having flowed into the heat exchanger related to heat medium 15*b* is condensed and liquefied while dissipating heat into the heat medium circulating through the first heat medium channel Bb and becomes a liquid refrigerant. The liquid refrigerant having flowed out of the heat exchanger related to heat medium 15*b* is expanded by the expansion device 16*b* becomes a low-pressure two-phase refrigerant. This low-pressure two-phase refrigerant flows into the heat exchanger related to heat medium 15*a*, which works as an evaporator, through the expansion device 16*a*. The low-pressure two-phase refrigerant having flowed into the heat exchanger related to heat medium 15*a* absorbs heat from the heat medium circulating in the first heat medium channel Ba and evaporates and cools the heat medium. This low-pressure two-phase refrigerant flows out of the heat exchanger related to heat medium 15*a*, flows out of the relay unit 3B through the second refrigerant flow direction switching device 18*a* and the on-off device 17*f* and flows into the outdoor unit 1B again through the refrigerant pipeline 4(2).

The refrigerant having flowed into the outdoor unit 1B flows into the heat-source-side heat exchanger 12, which works as an evaporator. Then, the refrigerant having flowed into the heat-source-side heat exchanger 12 absorbs heat from the outdoor air in the heat-source-side heat exchanger 12 and becomes a low-temperature and low-pressure gas refrigerant. The low-temperature and low-pressure gas refrigerant having flowed out of the heat-source-side heat exchanger 12 is sucked into the compressor 10 again through the flow direction switching section 41 and the accumulator 19.

The first heat medium flow direction switching device 22, the second heat medium flow direction switching device 23, and the pump flow direction switching device 24 described in the embodiment may be of any type as long as the flow direction can be switched such as a device capable of switching three-flow paths such as a three-way valve or the like, combination of two devices which open/close two-flow paths such as an on-off valve. Also, two of a device which can change flow rates of the three-flow paths such as a mixed valve or the like of a stepping-motor driving type and a device which can change the flow rate of the two-flow paths such as an electronic expansion valve or the like may be combined so as to be used as the first heat medium flow direction switching device 22 and second heat medium flow direction switching device 23. In this case, water hammer caused by abrupt opening/closing of a flow path can be also prevented. Moreover, in the embodiment, the example in which the heat medium flow control device 25 is a two-way valve of a stepping motor driving type is described, but it may be a control valve having three-flow paths and may be installed together with a bypass pipe which bypasses the use-side heat exchanger 26.

Also, as the heat-source-side refrigerant, a single refrigerant such as R-22, R-134a, a near-azeotropic refrigerant mixture such as R-410A, R-404A, a non-azeotropic refrigerant mixture such as R-407C, a refrigerant containing a double bond in the chemical formula and having a relatively small global warming potential value such as $CF_3CF{=}CH_2$ or a mixture thereof or a natural refrigerant such as $CO_2$, propane can be used. In the heat exchanger related to heat medium 15*a* or the heat exchanger related to heat medium 15*b* operating for heating, the refrigerant which makes a usual two-phase change is condensed and liquefied, and the refrigerant which becomes a supercritical state such as $CO_2$ is cooled in the supercritical state, but in either case, the rest works the same and the same effects are exerted.

Also, as the heat medium, brine (anti-freezing solution), water, a mixed solution of brine and water, a mixed solution of water and an additive having a high anti-corrosion effect and the like can be used, for example. Therefore, in the air-conditioning apparatus 100, even if the heat medium leaks into the indoor space 7 through the indoor unit 2, since a highly safe heat medium is used, contribution can be made to improvement of safety.

Also, in the embodiment, the example in which the accumulator 19 is included in the air-conditioning apparatus 100 is described, but the accumulator 19 does not have to be provided. Also, in the embodiment, the example in which the check valve 13*a* to the check valve 13*d* are provided in the air-conditioning apparatus 100 is described, but they are not indispensable components. Therefore, it is needless to say that even without providing the accumulator 19 or the check valve 13*a* to the check valve 13*d*, the same operation is performed, and the same effects are exerted.

Also, a fan is mounted in the heat-source-side heat exchanger 12 and the use-side heat exchanger 26 in general, and condensation or evaporation is promoted by air blown by a fan in many cases, but this is not limiting. For example, as the use-side heat exchanger 26, a panel heater using radiation can be also used, and as the heat-source-side heat exchanger 12, a water-cooled type in which heat is moved by water or an anti-freezing solution can be also used. That is, as the heat-source-side heat exchanger 12 and the use-side heat exchanger 26, any type can be used as long as it has a structure that heat can be dissipated or absorbed. Also, the number of the use-side heat exchangers 26 is not particularly limited.

Also, in the embodiment, the example in which the first heat medium flow direction switching device 22, the second heat medium flow direction switching device 23, and the heat medium flow control device 25 are connected to each of the use-side heat exchangers 26 one by one is described, but this is not limiting, and each of them may be connected in plural to the same use-side heat exchanger 26. In this case, it is only necessary that the first heat medium flow direction switching device 22, the second heat medium flow direction on-off device 23, and the heat medium flow control device 25 connected to the same use-side heat exchanger 26 are operated in the same way.

Also, in the embodiment, the example in which there are two heat exchangers related to heat medium 15 is described, but it is not limited thereto naturally. Any number of the heat exchangers related to heat medium 15 may be installed as long as they are configured to be able to cool or/and heat the heat medium. In this case, it is not necessary to make all the first heat medium channels B connected to the indoor units 2 having large air-conditioning loads communicate with the pump 21*c* and any of these first heat medium channels B may be made to communicate with the pump 21*c*.

Also, in the embodiment, the pump 21*c* is configured to communicate with the suction sides and the discharge sides of the pump 21*a* and the pump 21*b*, but the pump 21*c* may be installed at an arbitrary position of the first heat medium channel Ba and the first heat medium channel Bb.

As described above, the air-conditioning apparatus 100 according to the embodiment can perform a safe and highly energy-saving operation by controlling the heat medium flow direction switching device (the first heat medium flow direction switching device 22 and the second heat medium flow direction switching device 23) on the heat medium side, the heat medium flow control device 25, and the pump 21,

REFERENCE SIGNS LIST

1 outdoor unit, 1B outdoor unit, 2 indoor unit, 2*a* indoor unit, 2*b* indoor unit, 2*c* indoor unit, 2*d* indoor unit, 3 relay unit, 3B relay unit, 3*a* main relay unit, 3*b* sub relay unit, 4 refrigerant pipeline, 4*a* first connection pipeline, 4*b* second connection pipeline, 5 pipeline, 6 outdoor space, 7 indoor space, 8 space, 9 building, 10 compressor, 11 first refrigerant flow direction switching device, 12 heat-source-side heat exchanger, 13*a* check valve, 13*b* check valve, 13*c* check valve, 13*d* check valve, 14 gas-liquid separator, 15 heat exchanger related to heat medium, 15*a* heat exchanger related to heat medium, 15*b* heat exchanger related to heat medium, 16 expansion device, 16*a* expansion device, 16*b* expansion device, 16*c* expansion device, 16*d* expansion device, 17 on-off device, 17*a* on-off device, 17*b* on-off device, 17*c* on-off device, 17*d* on-off device, 17*e* on-off device, 17*f* on-off device, 18 second refrigerant flow direction switching device, 18*a* second refrigerant flow direction switching device, 18*b* second refrigerant flow direction switching device, 19 accumulator, 21 pump, 21*a* pump, 21*b* pump, 21*c* pump, 22 first heat medium flow direction switching device, 22*a* first heat medium flow direction switching device, 22*b* first heat medium flow direction switching device, 22*c* first heat medium flow direction switching device, 22*d* first heat medium flow direction switching device, 23 second heat medium flow direction switching device, 23*a* second heat medium flow direction switching device, 23*b* second heat medium flow direction switching device, 23*c* second heat medium flow direction switching device, 23*d* second heat medium flow direction switching device, 24 pump flow direction switching device, 24*a* pump flow direction switching device, 24*b* pump flow control device, 25 heat medium flow control device, 25*a* heat medium flow control device, 25*b* heat medium flow control device, 25*c* heat medium flow control device, 25*d* heat medium flow control device, 26 use-side heat exchanger, 26*a* use-side heat exchanger, 26*b* use-side heat exchanger, 26*c* use-side heat exchanger, 26*d* use-side heat exchanger, 31 first temperature sensor, 31*a* first temperature sensor, 31*b* first temperature sensor, 34 second temperature sensor, 34*a* second temperature sensor, 34*b* second temperature sensor, 34*c* second temperature sensor, 34*d* second temperature sensor, 35 third temperature sensor, 35*a* third temperature sensor, 35*b* third temperature sensor, 35*c* third temperature sensor, 35*d* third temperature sensor, 36 pressure sensor, 41 flow direction switching section, 42 flow direction switching section, 100 air-conditioning apparatus, 100A air-conditioning apparatus, 100E air-conditioning apparatus, A refrigerant cycle, B first heat medium channel, C second heat medium channel.

The invention claimed is:

1. An air-conditioning apparatus including at least a compressor, a heat-source-side heat exchanger, a plurality of expansion devices, a plurality of heat exchangers related to heat medium, a plurality of first heat-medium feeding devices, a plurality of use-side heat exchangers, a second heat-medium feeding device, a first heat-medium flow direction switching device, and a second heat-medium flow direction switching device, comprising:

a refrigerant cycle connecting the compressor, the heat-source-side heat exchanger, the plurality of expansion devices, and heat-source-side refrigerant channels of the plurality of heat exchangers related to heat medium, the refrigerant cycle circulating a heat-source-side refrigerant;

a plurality of first heat medium channels each connecting the heat-medium-side channel of each of the heat exchangers related to heat medium and each of the first heat-medium feeding devices, each of the first heat medium channels circulating a heat medium different from the heat-source-side refrigerant; and a plurality of second heat medium channels each connecting each of the use-side heat exchanger and at least one of the first heat medium channels, each of the second heat medium channels circulating the heat medium, the first heat-medium flow direction switching device being connected to a suction side of the second heat-medium feeding device and at least two of the first heat medium channels, the second heat-medium flow direction switching device being connected to a discharge side of the second heat-medium feeding device and the first heat medium channel to which the first heat-medium flow direction switching device is connected, and the apparatus selecting the first heat medium channel, which communicates with the second heat-medium feeding device, by controlling the first heat-medium flow direction switching device and the second heat-medium flow direction switching device.

2. The air-conditioning apparatus of claim 1, wherein:

the compressor and the heat-source-side heat exchanger are stored in an outdoor unit;

the plurality of expansion devices, the plurality of heat exchangers related to heat medium, the plurality of first heat-medium feeding devices, the second heat-medium feeding devices, the first heat-medium flow direction switching device, and the second heat-medium flow direction switching device are stored in a relay unit;

the use-side heat exchanger is stored in an indoor unit; and the outdoor unit, the relay unit, and the indoor unit are formed individually and can be installed at locations separate from each other.

3. The air-conditioning apparatus of claim 1, being capable of executing a cooling and heating mixed operation mode in which a high-temperature and high-pressure heat-source-side refrigerant discharged from the compressor is made to flow through part of the plurality of heat exchangers related to heat medium so as to heat the heat medium, and a low-temperature and low-pressure heat-source-side refrigerant is made to flow through the other part of the plurality of heat exchangers related to heat medium so as to cool the heat medium, wherein:

in a case of the cooling and heating mixed operation mode, at least one of the first heat medium channels, in which the first heat-medium feeding device circulating the heat medium for heating is disposed, communicates with the second heat-medium feeding device when a heating load is larger than a cooling load, and at least one of the first heat medium channels, in which the first heat-medium feeding device circulating the heat medium for cooling is disposed, communicates with the second heat-medium feeding device when a cooling load is larger than a heating load.

4. The air-conditioning apparatus of claim 1, wherein a rotation speed instruction value of the second heat-medium feeding device is set to be the same as a rotation speed instruction value of the first heat-medium feeding device disposed in any of the first heat medium channels which communicate with the second heat-medium feeding device.

5. The air-conditioning apparatus of claim 2, wherein the outdoor unit and the relay unit are connected by two refrigerant pipelines and the relay unit and the indoor unit are connected by two heat medium pipelines.

6. An air-conditioning apparatus including at least a compressor, a heat-source-side heat exchanger, a plurality of expansion devices, a plurality of heat exchangers related to heat medium, a plurality of first heat-medium feeding devices, a plurality of use-side heat exchangers, a second heat-medium feeding device, a first heat-medium flow direction switching device, a second heat-medium flow direction switching device, a plurality of third heat-medium flow direction switching devices, and a plurality of fourth heat-medium flow direction switching devices, comprising:

a refrigerant cycle connecting the compressor, the heat-source-side heat exchanger, the plurality of expansion devices, and heat-source-side refrigerant channels of the plurality of heat exchangers related to heat medium, the refrigerant cycle circulating a heat-source-side refrigerant;

a plurality of first heat medium channels each connecting the heat-medium-side channel of the heat exchanger related to heat medium and the first heat-medium feeding device, each of first heat medium channels circulating a heat medium different from the heat-source-side refrigerant; and a plurality of second heat medium channels each connecting one end of a corresponding first heat medium cycle of the first heat medium cycles and one end of a corresponding use-side heat exchanger of the use-side heat exchangers through a corresponding switching device of the third heat-medium flow direction switching devices, and each connecting the other end of the corresponding use-side heat exchanger and the other end of the corresponding first heat medium cycle through a corresponding switching device of the fourth heat-medium flow direction switching devices, each of the second heat medium channels circulating the heat medium, wherein:

the compressor and the heat-source-side heat exchanger are stored in an outdoor unit;

the plurality of expansion devices, the plurality of heat exchangers related to heat medium, the plurality of first heat-medium feeding devices, the second heat-medium feeding devices, the first heat-medium flow direction switching device, the second heat-medium flow direction switching device, the plurality of third heat-medium flow direction switching devices, and the plurality of fourth heat-medium flow direction switching devices are stored in a relay unit;

the use-side heat exchanger is stored in an indoor unit; and the outdoor unit, the relay unit, and the indoor unit are formed individually and can be installed at locations separate from each other, the first heat-medium flow direction switching device being connected to the suction side of the second heat-medium feeding device and at least two of the first heat medium channels, the second heat-medium flow direction switching device being connected to the discharge side of the second heat-medium feeding device and the first heat medium channel which connects the first heat-medium flow direction switching device, and the apparatus selecting the first heat medium channel, which communicates with the second heat-medium feeding device, by controlling the first heat-medium flow direction switching device and the second heat-medium flow direction switching device.

7. The air-conditioning apparatus of claim 6, being capable of executing a cooling and heating mixed operation mode in which a high-temperature and high-pressure heat-source-side refrigerant discharged from the compressor is made to flow through part of the plurality of heat exchangers related to heat medium so as to heat the heat medium, and a low-temperature and low-pressure heat-source-side refrigerant is made to flow through the other part of the plurality of heat exchangers related to heat medium so as to cool the heat medium, wherein:

in a case of the cooling and heating mixed operation mode, at least one of the first heat medium channels, in which the first heat-medium feeding device circulating the heat medium for heating is disposed, communicates with the second heat-medium feeding device when a heating load is larger than a cooling load, and at least one of the first heat medium channels, in which the first heat-medium feeding device circulating the heat medium for cooling is disposed, communicates with the second heat-medium feeding device when a cooling load is larger than a heating load.

8. The air-conditioning apparatus of claim 6, wherein a rotation speed instruction value of the second heat-medium feeding device is set to be the same as a rotation speed instruction value of the first heat-medium feeding device disposed in any of the first heat medium channels which communicate with the second heat-medium feeding device.

9. The air-conditioning apparatus of claim 6, wherein the outdoor unit and the relay unit are connected by two refrigerant pipelines and the relay unit and the indoor unit are connected by two heat medium pipelines.

* * * * *